US006660056B2

(12) United States Patent
Hayashi et al.

(10) Patent No.: US 6,660,056 B2
(45) Date of Patent: Dec. 9, 2003

(54) VALVE SEAT FOR INTERNAL COMBUSTION ENGINES

(75) Inventors: Koichiro Hayashi, Kashiwa (JP); Hideaki Kawata, Matsudo (JP); Toru Tsuboi, Kamagaya (JP)

(73) Assignee: Hitachi Powdered Metals Co., Ltd., Chiba (JP)

( * ) Notice: Subject to any disclaimer, the term of this patent is extended or adjusted under 35 U.S.C. 154(b) by 0 days.

(21) Appl. No.: 09/846,824

(22) Filed: May 1, 2001

(65) Prior Publication Data

US 2001/0037842 A1 Nov. 8, 2001

(30) Foreign Application Priority Data

May 2, 2000 (JP) ..... 2000-133915

(51) Int. Cl.[7] ..... C22C 1/05

(52) U.S. Cl. ..... 75/243; 75/246; 75/230; 75/231

(58) Field of Search ..... 75/243, 246, 230, 75/231

(56) References Cited

U.S. PATENT DOCUMENTS

| | | | | | |
|---|---|---|---|---|---|
| 3,977,838 | A | * | 8/1976 | Hashimoto et al. | 419/11 |
| 4,123,265 | A | * | 10/1978 | Takahashi et al. | 419/27 |
| 4,345,943 | A | * | 8/1982 | Takahashi et al. | 75/236 |
| 4,360,383 | A | * | 11/1982 | Takahashi et al. | 419/10 |
| 4,790,875 | A | * | 12/1988 | Urano et al. | 419/47 |
| 5,188,659 | A | | 2/1993 | Purnell | 75/246 |
| 5,824,922 | A | | 10/1998 | Aonuma et al. | 75/236 |
| 5,834,664 | A | * | 11/1998 | Aonuma et al. | 419/27 |
| 5,872,322 | A | | 2/1999 | Mocarski et al. | |
| 6,318,327 | B1 | | 11/2001 | Takahashi et al. | 123/188.3 |

FOREIGN PATENT DOCUMENTS

| | | |
|---|---|---|
| EP | 0 354 389 A1 | 2/1990 |
| EP | 0 604 773 A1 | 7/1994 |
| EP | 0 785 288 A1 | 7/1997 |
| GB | 1 500 736 | 2/1978 |
| JP | 1-168851 | 7/1989 |

OTHER PUBLICATIONS

Abstract of Japanese Laid–Open Patent Application No. 08–024888, published Jul. 29, 1997.

Abstract of Japanese Laid–Open Patent Application No. 08–024889, published Jul. 29, 1997.

Abstract of Japanese Laid–Open Patent Application No. 08–024890, published Jul. 29, 1997.

* cited by examiner

*Primary Examiner*—Ngoclan Mai
(74) *Attorney, Agent, or Firm*—Scully, Scott, Murphy & Presser

(57) ABSTRACT

A valve seat is provided in which wear resistance can be ensured by optimizing the matrix structure without dispersing of expensive hard particles, and therefore the machinability can be improved and the holding down of cost can be achieved. The valve seat exhibits a metallographic structure consisting of only bainite single phase or only a mixed phase of bainite and martensite, has an area ratio of bainite and martensite in cross section of 100:0 to 50:50, and has a matrix hardness of 250 to 850 Hv.

14 Claims, 19 Drawing Sheets

CONTINUOUS COOLING TRANSFORMATION DIAGRAM OF LOW C STEEL CONTAINING Mo

MACHINABILITY IMPROVING COMPONENT

CARRYING OUT INFILTRATION OR IMPREGNATION

VALVE SEAT FOR INTERNAL COMBUSTION ENGINES

BACKGROUND OF THE INVENTION

The present invention relates to an Fe-based sintered valve seat suitable for use, for example, in internal combustion engines, etc., and more particularly, relates to a technology in which the high-temperature wear resistance and the machinability are improved by improving the matrix.

In order to cope with the recent slowdown, the automobile industry has optimally designed each part so that unnecessarily high performance is reduced according to a cost reduction policy, and with respect to the valve seats for internal combustion engines, not only securing desired wear resistance but also good machinability and inexpensiveness have been more severely required. The present applicants also previously proposed inexpensive sintered alloys having superior wear resistance in which the wear resistance and machinability are improved in Japanese Unexamined Patent Publications Nos. 9-195012, 9-195013, 9-195014, and 11-335799.

A sintered alloy having superior wear resistance disclosed in Japanese Unexamined Patent Publication No. 9-195012 is characterized in that the overall composition consists of, by weight ratio, Ni: 0.736 to 9.65%, Cu: 0.736 to 2.895%, Mo: 0.294 to 0.965%, Cr: 0.12 to 6.25%, C: 0.508 to 2.0%, that a metallographic structure consisting of: ① martensite, ② bainite surrounding a core consisting of sorbite and/or upper bainite, ③ austenite having high Ni concentration, and ④ hard phase mainly consisting of Cr carbide coated by ferrite having a high Cr concentration, is exhibited, and that a powder mixed with a powder in which Ni: 1 to 10%, Cu: 1 to 3%, Mo: 0.4 to 1%, are partially diffused and adhered to Fe powder, an Fe—Cr alloy powder in an amount of 3 to 25% consisting of Cr: 4 to 25%, C: 0.25 to 2.4%, and the balance consisting of Fe, and a graphite powder in an amount of 0.5 to 1.4%, is employed.

A sintered alloy having superior wear resistance disclosed in Japanese Unexamined Patent Publication No. 9-195013 is characterized in that the overall composition consists of, by weight ratio, Ni: 0.736 to 5.79%, Cr: 0.12 to 6.25%, Mo: 0.294 to 0.965%, C: 0.508 to 2.0%, that a metallographic structure in which a phase of ferrite which has high a Cr concentration and which surrounds a core made of hard phases mainly consisting of Cr carbide and martensite which further surrounds the ferrite disperses in a matrix of bainite or a mixed structure of bainite and sorbite, is exhibited, and that a powder mixed with an alloy powder of Ni: 1 to 6%, and Mo: 0.4 to 1%, an Fe—Cr alloy powder in an amount of 3 to 25% consisting of Cr: 4 to 25%, C: 0.25 to 2.4%, and the balance consisting of Fe, and a graphite powder in an amount of 0.5 to 1.4%, is employed.

A sintered alloy having superior wear resistance disclosed in Japanese Unexamined Patent Publication No. 9-195014 is characterized in that the overall composition consists of, by weight ratio, Ni: 0.736 to 5.79%, Cr: 0.12 to 6.25%, Mo: 0.368 to 1.93%, C: 0.508 to 2.0%, that a metallographic structure in which a phase of ferrite which has high a Cr concentration and which surrounds a core made of hard phases mainly consisting of Cr carbide and martensite which further surrounds the ferrite disperses in a mixed structure of ① bainite, or bainite and sorbite, ② martensite, ③ austenite, is exhibited, and that a powder in which Ni: 1 to 6% is partially diffused and adhered to an alloy powder of Mo: 0.5 to 2%, and the balance consisting of Fe, an Fe—Cr alloy powder in an amount of 3 to 25% consisting of Cr: 4 to 25%, C: 0.25 to 2.4%, and the balance consisting of Fe, and a graphite powder in an amount of 0.5 to 1.4%, is employed.

A sintered alloy having superior wear resistance disclosed in Japanese Unexamined Patent Publication No. 11-335799 is characterized in that the austenite content in a metallographic structure is optimized by carrying out a subzero treatment on a sintered compact in which Fe—Cr alloy powders disclosed in the Japanese Unexamined Patent Publications Nos. 9-195012, 9-195013, and 9-195014, are added to a matrix strengthened by adding Ni powder to Fe powder and are compact-sintered, in order to form a hard phase.

Thus, the present applicants also follow the demands of the times and have provided sintered alloys for valve seats which have superior wear resistance and machinability and which are inexpensive; however, optimization of performance and lower cost are further desired due to the recent business stagnation.

SUMMARY OF INVENTION

The present inventors have found that desired wear resistance can be ensured by optimizing the matrix structure even if a hard phase is not dispersed therein, and have succeeded in development of a valve seat, in which machinability thereof is improved and in which cost thereof is held down, by not adding hard particles. That is, a valve seat of the present invention is characterized in that a metallographic structure consisting of only bainite single phase or only a mixed phase of bainite and martensite is exhibited, that a ratio of bainite and martensite in cross section thereof is 100:0 to 50:50, and that the matrix hardness is 250 to 850 Hv.

In the following, the basis for the numerical limitations will be explained with the effects thereof. In the following explanations, "%" refers to "% by weight".

Generally, it is believed that martensite is hard and has high strength because martensite tempered after quenching is usually used. However, in the case in which a martensite structure is used in a valve seat, the strength is instead lower than other structures since the tempering is generally not carried out. In addition, although a valve seat is generally processed for centering adjustment after it is assembled with a valve guide in an engine head, it is not preferable that a valve seat consist of hard martensite since machinability thereof is deteriorated. Furthermore, since martensite is hard but has a weak structure, during driving of an engine, a valve as a counterpart component is worn, the worn particle acts like grinder particles, and with respect to a valve seat as well as the counterpart component, wear is promoted. Therefore, a single structure of martensite cannot be used as a valve seat. Alternatively, ferrite and pearlite are unsuitable for valve seats since they have low hardness and low strength and their wear resistances are low.

From the above reasons, the present inventors directed attention to bainite as a metallographic structure. According to research by the present inventors, bainite is hardest after martensite and is a structure having high strength, and it is preferable that bainite having a matrix hardness of 250 Hv or more be used for a valve seat as a single structure since its low wear resistance and small attackability to a counterpart component are well balanced. That is, it has been found that the hardness is insufficient and the wear amount is increased in the case in which the matrix hardness is below 250 Hv even if the matrix is bainite.

The present inventors have found that although bainite may be used alone, martensite may be dispersed in an amount of up to 50% in a matrix structure of bainite in order to further improve wear resistance. In contrast, when martensite is contained at 50% or more, the above properties are remarkably exhibited, attackability to a counterpart component is increased, and therefore wear resistance is decreased. Alternatively, when martensite has a matrix hardness harder than 850 Hv even if it is contained at 50% or less, the martensite is unsuitable as a valve seat since it is weak and attackability to a counterpart component is high.

As described in the above, in a matrix consisting of only bainite single phase or only a mixed phase of bainite and martensite, its own wear resistance is sufficient. When hard phases are further contained therein, not only is cost uselessly increased, but also machinability is deteriorated and attackability to a counterpart component is further increased. Therefore, it is not necessary that hard phases be further contained. The above structure consisting of bainite single phase or a mixed phase of bainite and martensite can be obtained by controlling the cooling rate and isothermal-transformation; however, such a process is disadvantageous in cost. Thus, it is ideal that the above structure be obtained in a cooling process after generally sintering. In order to do this, such component compositions as the following are desirable.

In order to easily obtain the above metallographic structure of a valve seat, it is desirable that Mo be contained at 0.4 to 4% and C be contained at 0.2 to 1.1%, by weight ratio, and that C be contained in an eutectoid composition amount or a hypo-eutectoid composition amount. When C is contained in a hyper-eutectoid composition amount, cementite like network is precipitated along the crystal in the matrix, acts as a hard phase, so that attackability to a counterpart component is increased, and lowered machinability and strength.

In addition, when further improvement of wear resistance is desired, it is desirable that at least one element of Ni: 0.6 to 5%, Cu: 0.5 to 5%, Cr: 0.05 to 2%, Mn: 0.09 to 1% and V: 0.05 to 0.6%, by weight ratio, be further contained in the above valve seat. Furthermore, when further improvement of machinability is desired, it is desirable that at least one compound of MnS particles, magnesium metasilicate mineral particles, $CaF_2$ particles, BN particles, $MoS_2$ particles, and FeS particles, be further dispersed in an amount of 0.1 to 1.5%, by weight ratio, in the above metallographic structure of the valve seat, and/or that any of acrylic resin, lead, and lead alloy be filled in pores of the valve seat.

The basis for the numerical limitations of the above components are as follows.

Mo: Mo in steel has an action which shifts pearlite region in the CCT (continuous cooling transformation) diagram to the side in which the cooling rate is low, as shown in FIG. 1, and an action which expands the bainite region. Therefore, a bainitic structure is easily obtained at the cooling rate of the inside of a furnace after sintering by containing Mo in a suitable amount. In addition, Mo has an action which increases temper hardening of the matrix, and in a valve seat in which heating and cooling are repeated, it is effective for preventing plastic deformation in use. When the content of Mo is below 0.4%, the above effect is insufficient and pearlite remains in the matrix structure. In contrast, when the content of Mo exceeds 4%, the above improving effect is decreased, Mo hyper-eutectoid carbide (hard phase) is easily precipitated, and therefore attackability to a counterpart component is increased with lowering of machinability. In order to uniformly obtain this action of Mo in the overall matrix, it is desirable that Mo be given in the form of Fe—Mo alloy powder.

C: C is added for shifting the ferrite region in the CCT diagram to the side in which the cooling rate is low and for obtaining a structure consisting of bainite single phase at a furnace cooling rate after sintering. Since when C is given in a form which dissolves in alloy powder, compressibility is lowered by hardening the powder, overall C is given in the form of graphite powder. When the C content in the matrix is below 0.2%, an effect as described in the above is insufficient and ferrite remains. In contrast, when the C content exceeds 1.1%, hyper-eutectoid carbide (hard phase) is precipitated, and attackability to a counterpart component is increased with lowering of machinability. More preferably, the C content in which eutectoid composition is formed in the matrix is desirable.

In order to attempt improvement of wear resistance by strengthening the matrix, the following elements can further be added.

Ni: Ni is added for strengthening by dissolving in the matrix and for easily obtaining martensite at a slow cooling rate of furnace after sintering. In order to obtain this effect, it is necessary that the Ni content be 0.6% or more. Alternatively, it is necessary that the upper limit be 5% since the martensite content increases and the austenite in which wear resistance is low remains when Ni is added in excess.

When Ni is added by dissolving in Fe—Mo alloy powder, Ni is made uniform, and therefore a bainite single phase structure is easily obtained. In contrast, when Ni is given in the form of a simple powder or powder in which it is adhered to the above Fe—Mo alloy powder by partially diffusing, a region having a high Ni concentration is unevenly distributed in the matrix and the region having a high Ni concentration is transformed into martensite, and therefore the structure in which martensite is dispersed in the bainite structure is easily obtained. However, in the case in which Ni is used as a simple powder, it is necessary that Ni be sufficiently diffused by setting a sufficient sintering time, since austenite remains if Ni is insufficiently diffused.

Cr: Cr has an effect which shifts the pearlite region in the CCT diagram to the side in which the cooling rate is low and an action which expands the bainite region, is well is those of Mo. In order to obtain such effects, it is necessary that the Cr content be 0.05% or more. In order to uniformly obtain this effect in the overall matrix, it is preferable that Cr be given in the form of alloy powder which dissolves in Fe—Mo alloy powder or alloy powder which is alloyed with other elements since Cr is easily oxidized. However, when Cr is added in excess, precipitation of Cr carbide is caused, and thereby attackability to a counterpart component is increased and machinability is lowered. Therefore, it is necessary that the upper limit of the Cr content be 2%.

Cu: Cu is added in an amount of 0.5% or more for strengthening by dissolving in the matrix and for easily obtaining martensite at a slow cooling rate of furnace after sintering. Alternatively, the upper limit is restricted to 5% since improvement of the matrix strengthening effect is lowered and soft Cu phase is precipitated in the matrix, when Cu is added in excess.

Mn: Mn has an effect which improves wear resistance by dissolving in the matrix and strengthening and an action which easily yields martensite at a slow cooling rate of furnace after sintering. In order to obtain such actions, it is necessary that the Mn content be 0.09% or more. It is desirable that Mn be given in the form of alloy powder which dissolves in Fe—Mo alloy powder or alloy powder which is alloyed with other elements since Mn is easily oxidized. Alternatively, when Mn is added in excess, the matrix strengthening effect is offset disadvantageously, and in addition, precipitation of Mn carbide is caused, and thereby attackability to a counterpart component is increased and machinability is lowered. Therefore, it is necessary that the Mn content be 1% or less.

V: V has an effect which shifts the pearlite region in the CCT diagram to the side in which the cooling rate is low and an effect which expands the bainite region, as well as those of Mo. In order to obtain such effects, it is necessary that the V content be 0.05% or more. In order to uniformly obtain this effect in the overall matrix, it is preferable that the V be given in the form of alloy powder which dissolves in Fe—Mo alloy powder or alloy powder which is alloyed with other element, since V is easily oxidized. However, when V is added in excess, precipitation of V carbide is caused, and thereby attackability to a counterpart component is increased and machinability is lowered. Therefore, it is necessary that the V content be 0.6% or less.

MnS, magnesium metasilicate mineral, $CaF_2$, BN, $MoS_2$, and FeS: It is preferable that particles consisting of at least one compound of MnS, magnesium metasilicate mineral, $CaF_2$, BN, $MoS_2$, and FeS be dispersed in an amount of 0.1 to 1.5% in the above metallographic structure of the valve seat. Since these are machinability improving components, they serve as an initiating point of chip breaking in a cutting operation by dispersing in the matrix, and machinability of sintered alloy can be improved. When the content of these machinability improving components is 0.1% or less, the effect is insufficient, and in contrast, when the content exceeds 1.5%, these machinability improving components inhibit diffusion of powders during sintering, and thereby the strength of sintered alloy is lowered. Therefore, the above content of machinability improving components is restricted to 0.1 to 1.5%.

Acrylic resin, and lead or lead alloy: It is preferable that lead, lead alloy, or acrylic resin be filled in pores of the above valve seat. Theses are also machinability improving components. In particular, when a sintered alloy having pores is cut, it is cut intermittently so that shocks are applied to the edge of the cutting tool. However, by having the pores filled with lead, or a lead alloy such a sintered alloy can be cut in a continuous manner, and prevent the shocks applied to the edge of the cutting tool. The lead and the lead alloy serve as a solid lubricant, and the acrylic resin serves as an initiating point of chip breaking in a cutting operation.

A process of production for a valve seat according to the present invention is characterized in that the valve seat contains Mo: 0.4 to 4%, and C: 0.2 to 1.1%, exhibits a metallographic structure consisting of only bainite single phase or only a mixed phase of bainite and martensite, has a ratio of bainite and martensite in cross section of 100:0 to 50:50, and his a matrix hardness of 250 to 850 Hv, and by comprising mixing Fe—Mo alloy powder consisting of Mo which corresponds to the overall amount of Mo, balance consisting of Fe, and inevitable impurities, and graphite powder which corresponds to the overall amount of C, and sintering this mixed powder after compacting.

Another process of production for a valve seat according to the present invention is characterized in that the valve seat contains at least one of Mo: 0.4 to 4%, C: 0.2 to 1.1%, Ni: 0.6 to 5%, Cu: 0.5 to 5%, Cr: 0.05 to 2%, Mn: 0.09 to 1%, and V: 0.05 to 0.6%, exhibits a metallographic structure consisting of only bainite single phase or only a mixed phase of bainite and martensite, has a ratio of bainite and martensite in cross section of 100:0 to 50:50, and has a matrix hardness of 250 to 850 Hv, and by comprising mixing alloy powder in which at least the Mo of the components which comprise the valve seat is dissolved in an amount which corresponds to the overall amount of Mo in Fe, and graphite powder which corresponds to the overall amount of C, and sintering this mixed powder after compacting.

In the above process of production, at least one of MnS powder, magnesium methasilicate mineral powder, $CaF_2$ powder, BN powder, $MoS_2$ powder, and FeS powder can be mixed in an amount of 0.1 to 1.5%. Additionally, in the above process of production, acrylic resin, lead, or lead alloy can also be infiltrated or impregnated in pores formed in a sintered alloy.

DETAILED DESCRIPTION OF THE PREFERRED EMBODIMENTS

Figure 1:
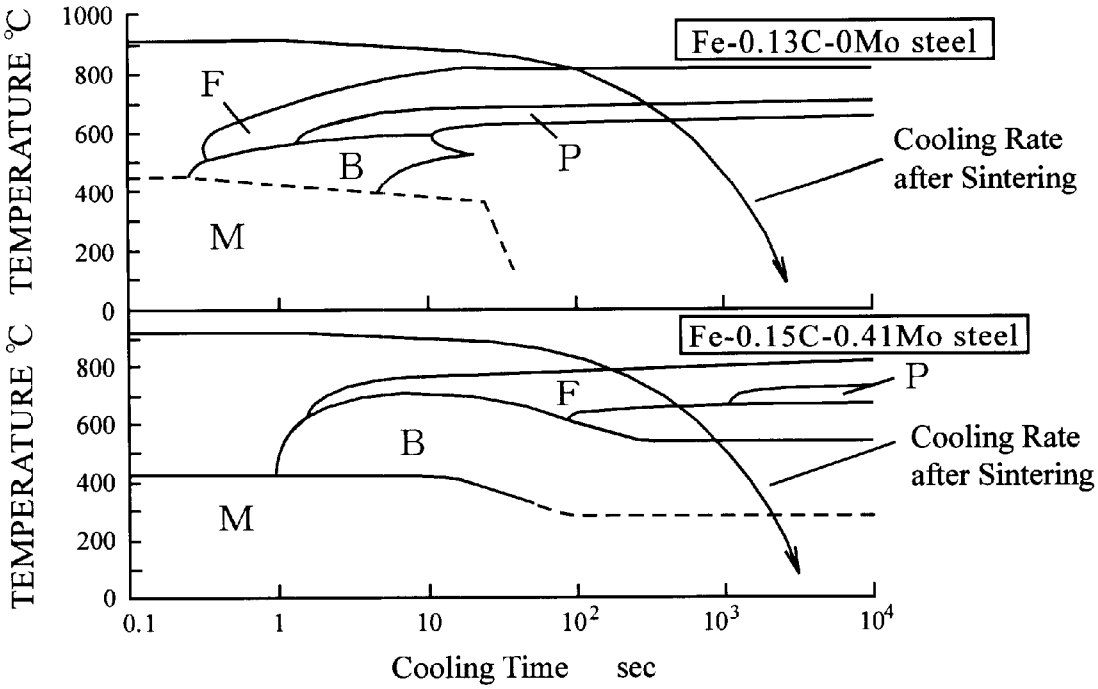
FIG. 1 is a continuous cooling transformation diagram of an alloy containing Mo.

Fe—Mo alloy powder, Ni powder, Cu powder, graphite powder consisting of compositions shown in Table 1 were prepared, and the powders were mixed at mixing ratios shown in Table 1. These mixed powders were compacted into cylindrical form having outer diameters of 50 mm, inner diameters of 45 mm, and heights of 10 mm, at a compacting pressure of 6.5 ton/cm$^2$, and were sintered by heating at 1180° C. for 60 minutes in a dissociated ammonia gas atmosphere, and alloys (alloys Nos. 1 to 50) having constituent compositions shown in Table 2 were obtained.

TABLE 1

| Sample No. | Powder Mixing Ratio WT % | | | | | | | | | | | |
|---|---|---|---|---|---|---|---|---|---|---|---|---|
| | Fe—Mo Alloy Powder | | | | | | | | | | | |
| | | Powder Composition WT % | | | | | Ni Powder | Cu Powder | Graphite Powder | Machinability Improving Powder | | Infiltration/ Impregnation |
| | | Fe | Mo | Ni | Cr | Mn | | | | | | |
| 01 | Balance | Balance | 0.30 | | | | | | 1.00 | | | None |
| 02 | Balance | Balance | 0.40 | | | | | | 1.00 | | | None |
| 03 | Balance | Balance | 0.50 | | | | | | 1.00 | | | None |
| 04 | Balance | Balance | 1.00 | | | | | | 1.00 | | | None |
| 05 | Balance | Balance | 1.50 | | | | | | 1.00 | | | None |
| 06 | Balance | Balance | 3.50 | | | | | | 1.00 | | | None |
| 07 | Balance | Balance | 4.00 | | | | | | 1.00 | | | None |
| 08 | Balance | Balance | 4.50 | | | | | | 1.00 | | | None |
| 09 | Balance | Balance | 1.50 | | | | 0.30 | | 1.00 | | | None |
| 10 | Balance | Balance | 1.50 | | | | 0.60 | | 1.00 | | | None |
| 11 | Balance | Balance | 1.50 | | | | 1.00 | | 1.00 | | | None |
| 12 | Balance | Balance | 1.50 | | | | 2.00 | | 1.00 | | | None |
| 13 | Balance | Balance | 1.50 | | | | 4.00 | | 1.00 | | | None |
| 14 | Balance | Balance | 1.50 | | | | 5.00 | | 1.00 | | | None |
| 15 | Balance | Balance | 1.50 | | | | 6.00 | | 1.00 | | | None |
| 16 | Balance | Balance | 1.00 | 1.00 | | 0.40 | | | 1.00 | | | None |
| 17 | Balance | Balance | 1.00 | 4.00 | | 0.40 | | | 1.00 | | | None |
| 18 | Balance | Balance | 1.50 | | | 0.40 | | | 1.00 | | | None |
| 19 | Balance | Balance | 1.50 | 1.00 | | 0.40 | | | 1.00 | | | None |
| 20 | Balance | Balance | 1.50 | 4.00 | | 0.40 | | | 1.00 | | | None |
| 21 | Balance | Balance | 3.50 | 1.00 | | 0.40 | | | 1.00 | | | None |
| 22 | Balance | Balance | 3.50 | 4.00 | | 0.40 | | | 1.00 | | | None |
| 23 | Balance | Balance | 1.00 | 1.00 | 0.05 | 0.40 | | | 1.00 | | | None |
| 24 | Balance | Balance | 1.00 | 1.00 | 0.50 | 0.40 | | | 1.00 | | | None |
| 25 | Balance | Balance | 1.00 | 1.00 | 1.00 | 0.40 | | | 1.00 | | | None |
| 26 | Balance | Balance | 1.00 | 1.00 | 2.00 | 0.40 | | | 1.00 | | | None |
| 27 | Balance | Balance | 1.00 | 1.00 | 2.40 | 0.40 | | | 1.00 | | | None |
| 28 | Balance | Balance | 1.50 | | | | | 0.50 | 1.00 | | | None |
| 29 | Balance | Balance | 1.50 | | | | | 1.00 | 1.00 | | | None |
| 30 | Balance | Balance | 1.50 | | | | | 2.00 | 1.00 | | | None |
| 31 | Balance | Balance | 1.50 | | | | | 4.00 | 1.00 | | | None |
| 32 | Balance | Balance | 1.50 | | | | | 5.00 | 1.00 | | | None |
| 33 | Balance | Balance | 1.50 | | | | | 6.00 | 1.00 | | | None |
| 34 | Balance | Balance | 1.50 | | | 0.40 | | | 0.10 | | | None |
| 35 | Balance | Balance | 1.50 | | | 0.40 | | | 0.20 | | | None |
| 36 | Balance | Balance | 1.50 | | | 0.40 | | | 0.60 | | | None |
| 37 | Balance | Balance | 1.50 | | | 0.40 | | | 0.80 | | | None |
| 38 | Balance | Balance | 1.50 | | | 0.40 | | | 1.10 | | | None |
| 39 | Balance | Balance | 1.50 | | | 0.40 | | | 1.40 | | | None |
| 40 | Balance | Balance | 1.50 | | | | 2.00 | | 1.00 | MnS Powder | 0.10 | None |
| 41 | Balance | Balance | 1.50 | | | | 2.00 | | 1.00 | MnS Powder | 0.30 | None |
| 42 | Balance | Balance | 1.50 | | | | 2.00 | | 1.00 | MnS Powder | 0.70 | None |
| 43 | Balance | Balance | 1.50 | | | | 2.00 | | 1.00 | MnS Powder | 1.50 | None |
| 44 | Balance | Balance | 1.50 | | | | 2.00 | | 1.00 | MnS Powder | 2.00 | None |
| 45 | Balance | Balance | 1.50 | | | | 2.00 | | 1.00 | $MgSiO_3$ Powder | 0.70 | None |
| 46 | Balance | Balance | 1.50 | | | | 2.00 | | 1.00 | $CaF_2$ Powder | 0.70 | None |
| 47 | Balance | Balance | 1.50 | | | | 2.00 | | 1.00 | FeS Powder | 0.70 | None |
| 48 | Balance | Balance | 1 50 | | | | 2.00 | | 1.00 | BN Powder | 0.70 | None |
| 49 | Balance | Balance | 1.50 | | | | 2.00 | | 1.00 | | | Acrylic Resin |
| 50 | Balance | Balance | 1.50 | | | | 2.00 | | 1.00 | | | Pb |

TABLE 2

| Sample No. | Overall Composition WT % | | | | | | | | | Infiltration/ Impregnation |
|---|---|---|---|---|---|---|---|---|---|---|
| | Fe | Nt | Mo | Cr | Mn | Cu | C | Machinability Improving Powder | | |
| 01 | Balance | | 0.30 | | | | 1.00 | | | None |
| 02 | Balance | | 0.40 | | | | 1.00 | | | None |
| 03 | Balance | | 0.50 | | | | 1.00 | | | None |
| 04 | Balance | | 0.99 | | | | 1.00 | | | None |
| 05 | Balance | | 1.49 | | | | 1.00 | | | None |
| 06 | Balance | | 3.47 | | | | 1.00 | | | None |
| 07 | Balance | | 3.96 | | | | 1.00 | | | None |
| 08 | Balance | | 4.46 | | | | 1.00 | | | None |
| 09 | Balance | 0.30 | 1.48 | | | | 1.00 | | | None |
| 10 | Balance | 0.60 | | | | | 1.00 | | | None |
| 11 | Balance | 1.00 | 1.47 | | | | 1.00 | | | None |
| 12 | Balance | 2.00 | 1.46 | | | | 1.00 | | | None |
| 13 | Balance | 4.00 | 1.43 | | | | 1.00 | | | None |
| 14 | Balance | 5.00 | 1.41 | | | | 1.00 | | | None |
| 15 | Balance | 6.00 | 1.40 | | | | 1.00 | | | None |
| 16 | Balance | 0.99 | 0.99 | | 0.40 | | 1.00 | | | None |
| 17 | Balance | 3.96 | 0.99 | | 0.40 | | 1.00 | | | None |
| 18 | Balance | | 1.49 | | 0.40 | | 1.00 | | | None |
| 19 | Balance | 0.99 | 1.49 | | 0.40 | | 1.00 | | | None |
| 20 | Balance | 3.96 | 1.49 | | 0.40 | | 1.00 | | | None |
| 21 | Balance | 0.99 | 3.47 | | 0.40 | | 1.00 | | | None |
| 22 | Balance | 3.96 | 3.47 | | 0.40 | | 1.00 | | | None |
| 23 | Balance | 0.99 | 0.99 | 0.05 | 0.40 | | 1.00 | | | None |
| 24 | Balance | 0.99 | 0.99 | 0.50 | 0.40 | | 1.00 | | | None |
| 25 | Balance | 0.99 | 0.99 | 0.99 | 0 40 | | 1.00 | | | None |
| 26 | Balance | 0.99 | 0.99 | 1.98 | 0.40 | | 1.00 | | | None |
| 27 | Balance | 0.99 | 0.99 | 2.38 | 0.40 | | 1.00 | | | None |
| 28 | Balance | | 1.48 | | | 0.50 | 1.00 | | | None |
| 29 | Balance | | 1.47 | | | 1.00 | 1.00 | | | None |
| 30 | Balance | | 1.46 | | | 2.00 | 1.00 | | | None |
| 31 | Balance | | 1.43 | | | 4.00 | 1.00 | | | None |
| 32 | Balance | | 1.41 | | | 5.00 | 1.00 | | | None |
| 33 | Balance | | 1.40 | | | 6.00 | 1.00 | | | None |
| 34 | Balance | | 1.50 | | 0.40 | | 0.10 | | | None |
| 35 | Balance | | 1.50 | | 0.40 | | 0.20 | | | None |
| 36 | Balance | | 1.49 | | 0.40 | | 0.60 | | | None |
| 37 | Balance | | 1.49 | | 0.40 | | 0.80 | | | None |
| 38 | Balance | | 1.48 | | 0.40 | | 1.10 | | | None |
| 39 | Balance | | 1.48 | | 0.39 | | 1.40 | | | None |
| 40 | Balance | 2.00 | 1.45 | | | | 1.00 | MnS | 0.10 | None |
| 41 | Balance | 2.00 | 1.45 | | | | 1.00 | MnS | 0.30 | None |
| 42 | Balance | 2.00 | 1.44 | | | | 1.00 | MnS | 0.70 | None |
| 43 | Balance | 2.00 | 1.43 | | | | 1.00 | MnS | 1.50 | None |
| 44 | Balance | 2.00 | 1.43 | | | | 1.00 | MnS | 2.00 | None |
| 45 | Balance | 2.00 | 1.44 | | | | 1.00 | $MgSiO_3$ | 0.70 | None |
| 46 | Balance | 2.00 | 1.44 | | | | 1.00 | $CaF_2$ | 0.70 | None |
| 47 | Balance | 2.00 | 1.44 | | | | 1.00 | FeS | 0.70 | None |
| 48 | Balance | 2.00 | 1.44 | | | | 1.00 | BN | 0.70 | None |
| 49 | Balance | 2.00 | 1.46 | | | | 1.00 | | | Acrylic Resin |
| 50 | Balance | 2.00 | 1.46 | | | | 1.00 | | | Pb |

The surfaces of the above alloys were corroded by nital etchant, and area ratios of bainite and martensite in metallographic structures were measured by microphotography using an image analysis apparatus (produced by Keyence Co., Ltd.), and the results are shown in Table 3. In addition, matrix hardnesses thereof were measured using a micro-Vickers hardness tester, and maximum values and minimum values of the matrix hardnesses were shown in Table 3. Furthermore, the above alloys were subjected to measurements of radial crushing strength and simple wear tests. The results are shown in Table 3. The simple wear test is a test in which a sintered alloy machined into the valve seat form is press-fitted in an aluminum alloy housing, and the valve is caused to move in an up-and-down piston like motion by an eccentric cam rotated by a motor, such that the face of the valve and the face of the valve seat repeatedly impact each other. The temperature setting in this test was carried out by heating the bevel of the valve with a burner in order to simply simulate an environment inside the housing of an engine. In this test, the rotating speed of the eccentric cam was set at 2700 rpm, the test temperature was set at 250° C. at the valve seat portion, and the repetition duration was set at 15 hours. The wear amounts on the valve seats and the valves were measured and evaluated after the tests.

TABLE 3

| Sample No. | Composition Ratio in Matrix % Bainite | Martensite | Matrix Hardness HV Minimum Value | Maximum Value | Wear Amount μm Valve Seat | Valve | Total | Radial Crushing Strength MPa | Comments |
|---|---|---|---|---|---|---|---|---|---|
| 01 | 100 | — | 171 | 250 | 200 | 10 | 210 | 908 | Residual Pearlite |
| 02 | 100 | — | 250 | 280 | 160 | 10 | 170 | 940 | |
| 03 | 100 | — | 260 | 300 | 148 | 10 | 158 | 955 | |
| 04 | 100 | — | 270 | 318 | 132 | 20 | 152 | 985 | |
| 05 | 100 | — | 282 | 374 | 122 | 20 | 142 | 1,005 | |
| 06 | 72 | 28 | 305 | 778 | 115 | 30 | 145 | 876 | |
| 07 | 60 | 40 | 300 | 825 | 113 | 45 | 158 | 810 | |
| 08 | 41 | 59 | 310 | 864 | 135 | 70 | 205 | 700 | |
| 09 | 100 | — | 286 | 383 | 115 | 20 | 135 | 1,015 | |
| 10 | 97 | 3 | 296 | 655 | 114 | 21 | 135 | 1,032 | |
| 11 | 94 | 6 | 315 | 693 | 112 | 21 | 133 | 1,057 | |
| 12 | 87 | 13 | 335 | 741 | 110 | 22 | 132 | 1,096 | |
| 13 | 63 | 37 | 338 | 807 | 108 | 26 | 134 | 1,032 | |
| 14 | 50 | 50 | 342 | 838 | 108 | 30 | 138 | 850 | |
| 15 | — | 100 | 205 | 865 | 160 | 75 | 235 | 650 | Residual Austenite |
| 16 | 100 | — | 280 | 370 | 130 | 23 | 153 | 950 | |
| 17 | 70 | 30 | 280 | 700 | 120 | 24 | 144 | 900 | |
| 18 | 100 | — | 290 | 381 | 118 | 20 | 138 | 1,015 | |
| 19 | 100 | — | 295 | 390 | 123 | 15 | 138 | 920 | |
| 20 | 63 | 37 | 300 | 750 | 110 | 25 | 135 | 890 | |
| 21 | 80 | 20 | 310 | 760 | 100 | 35 | 135 | 830 | |
| 22 | 52 | 48 | 315 | 780 | 90 | 40 | 130 | 800 | |
| 23 | 100 | — | 283 | 372 | 120 | 23 | 143 | 955 | |
| 24 | 92 | 8 | 303 | 661 | 112 | 25 | 137 | 990 | |
| 25 | 84 | 16 | 315 | 752 | 111 | 26 | 137 | 1,010 | |
| 26 | 70 | 30 | 323 | 828 | 109 | 39 | 148 | 931 | |
| 27 | 62 | 38 | 323 | 859 | 157 | 67 | 224 | 817 | |
| 28 | 100 | — | 291 | 403 | 112 | 20 | 132 | 1,050 | |
| 29 | 93 | 7 | 305 | 636 | 108 | 22 | 130 | 1,069 | |
| 30 | 82 | 18 | 303 | 710 | 108 | 24 | 132 | 1,096 | |
| 31 | 66 | 34 | 303 | 776 | 106 | 26 | 132 | 963 | |
| 32 | 52 | 48 | 300 | 825 | 104 | 30 | 134 | 835 | |
| 33 | 30 | 70 | 300 | 859 | 150 | 65 | 215 | 700 | |
| 34 | 100 | — | 180 | 250 | 195 | 10 | 205 | 695 | Residual Pearlite |
| 35 | 100 | — | 250 | 296 | 152 | 10 | 162 | 1,044 | |
| 36 | 100 | — | 270 | 328 | 136 | 10 | 146 | 1,112 | |
| 37 | 100 | — | 280 | 352 | 124 | 15 | 139 | 1,110 | |
| 38 | 67 | 33 | 300 | 752 | 118 | 28 | 146 | 936 | |
| 39 | 38 | 62 | 300 | 790 | 150 | 75 | 225 | 700 | |
| 40 | 87 | 13 | 335 | 730 | 133 | 15 | 148 | 1,022 | |
| 41 | 87 | 13 | 335 | 730 | 135 | 13 | 148 | 927 | |
| 42 | 87 | 13 | 335 | 730 | 142 | 12 | 154 | 850 | |
| 43 | 87 | 13 | 335 | 730 | 150 | 13 | 163 | 800 | |
| 44 | 87 | 13 | 335 | 730 | 188 | 32 | 220 | 477 | |
| 45 | 80 | 20 | 290 | 730 | 140 | 13 | 153 | 885 | |
| 46 | 81 | 19 | 290 | 730 | 138 | 10 | 148 | 895 | |
| 47 | 81 | 19 | 290 | 730 | 138 | 10 | 148 | 895 | |
| 48 | 79 | 21 | 290 | 730 | 140 | 12 | 152 | 870 | |
| 49 | 65 | 35 | 290 | 730 | 134 | 15 | 149 | 1,000 | |
| 50 | 65 | 35 | 270 | 720 | 130 | 10 | 140 | 1,200 | |

(1) Effect of Mo Content

Figure 2:
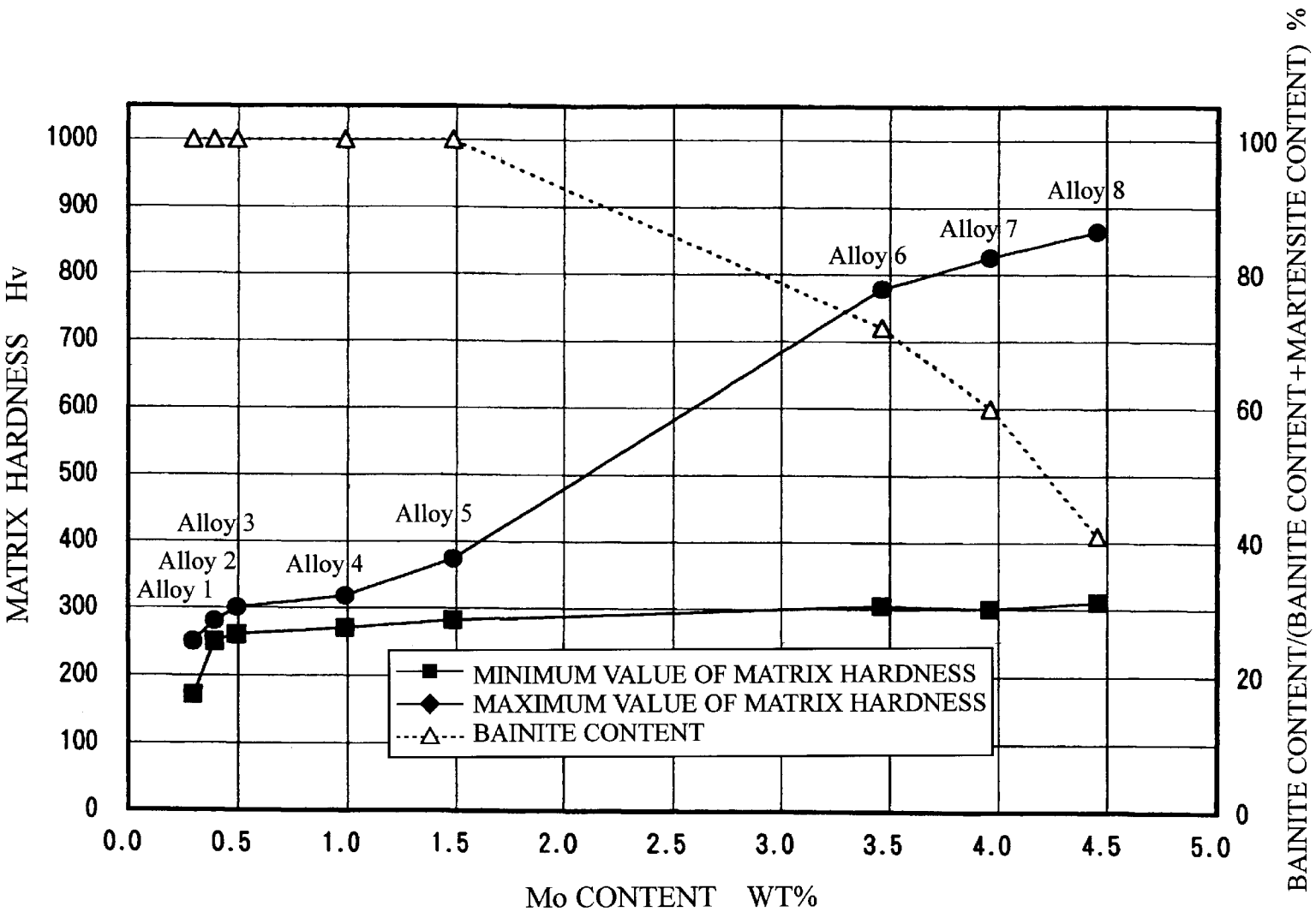
FIG. 2 is a graph showing the effect of Mo content on matrix hardness and bainite content.
Figure 3:
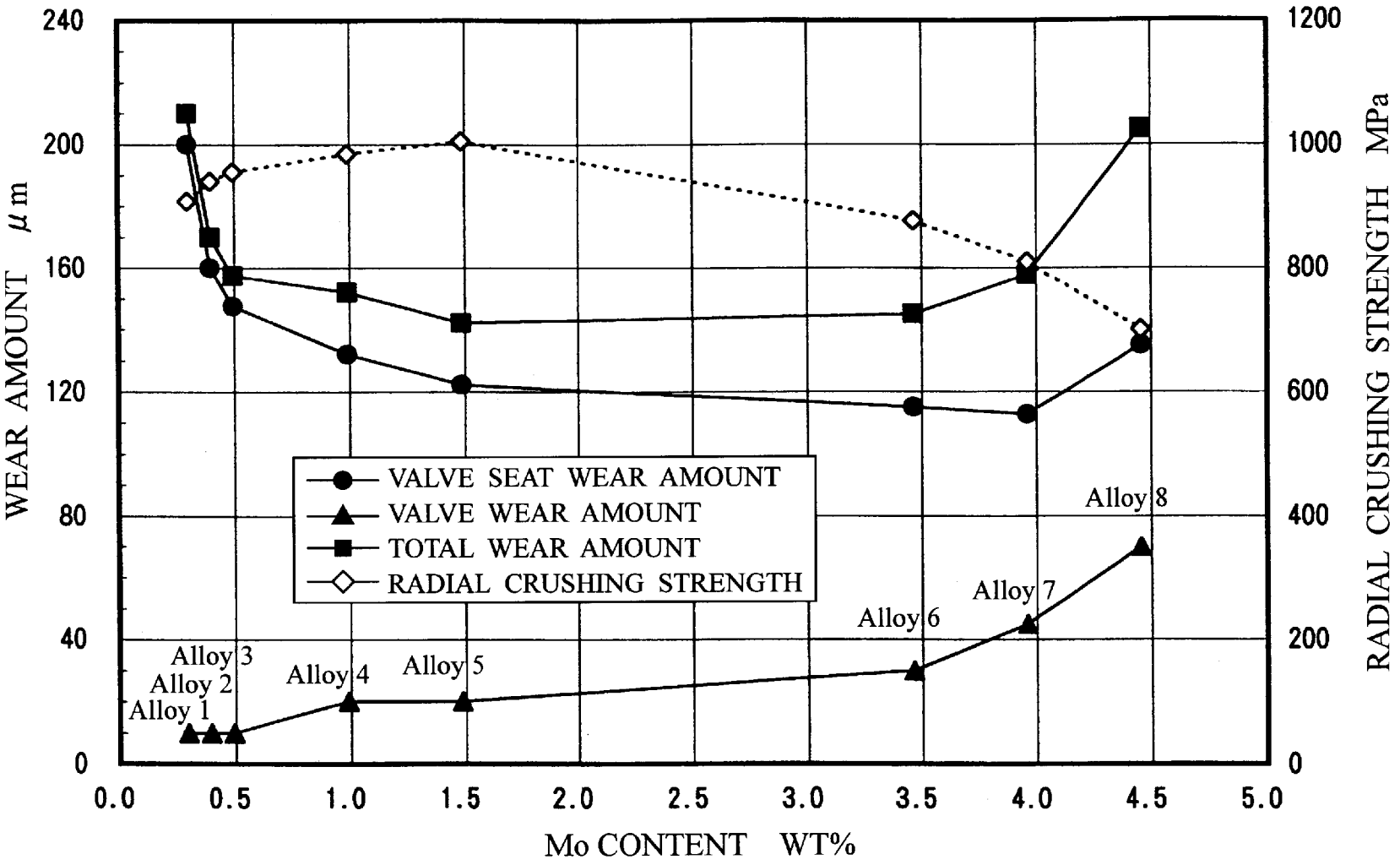
FIG. 3 is a graph showing the effect of Mo content on wear amount and radial crushing strength.

FIG. 2 shows the relationships between the Mo content of each alloy (alloys Nos. 1 to 8) of differing the Mo content and the matrix hardness or the bainite content (the ratio of bainite in a mixed structure of bainite and martensite), and FIG. 3 shows the relationships between the Mo content of each alloy and the wear amount or the radial crushing strength. As is apparent from FIGS. 2 and 3, when the Mo content is 0.4%, the matrix hardness remarkably increases, whereby the wear amount of the valve seat remarkably decreases and the radial crushing strength increases. Then, the matrix hardness also increases with increase of the Mo content, whereby the wear amount of the valve seat decreases and the radial crushing strength increases. When the Mo content is 1.5% or more, the ratio of martensite increases, whereby the matrix hardness increases and the radial crushing strength is lowered. In addition, the wear amount of the valve increases when the Mo content exceeds 3.5%, and in alloy 8 in which it exceeds 4%, the wear amount of the valve seat also increases. In the alloy 8, the ratio of martensite exceeds 50% and hyper-eutectoid carbide of Mo is formed and therefore the hardness exceeds 850 Hv. As a result, the wear of the valve is promoted, whereby the wear amount of the valve seat increases.

(2) Effect of Ni Content

Figure 4:
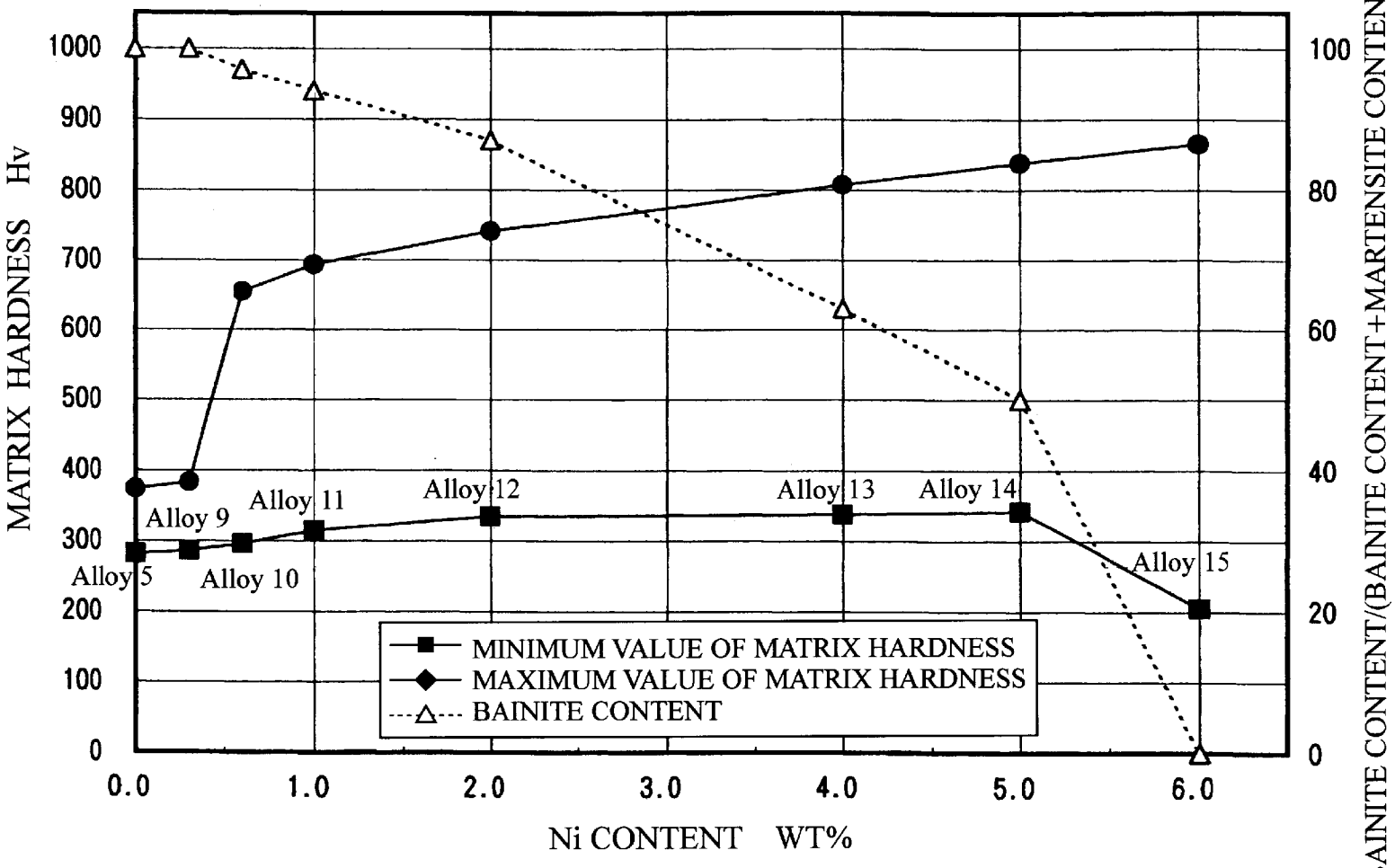
FIG. 4 is a graph showing the effect of Ni content on matrix hardness and bainite content.
Figure 5:
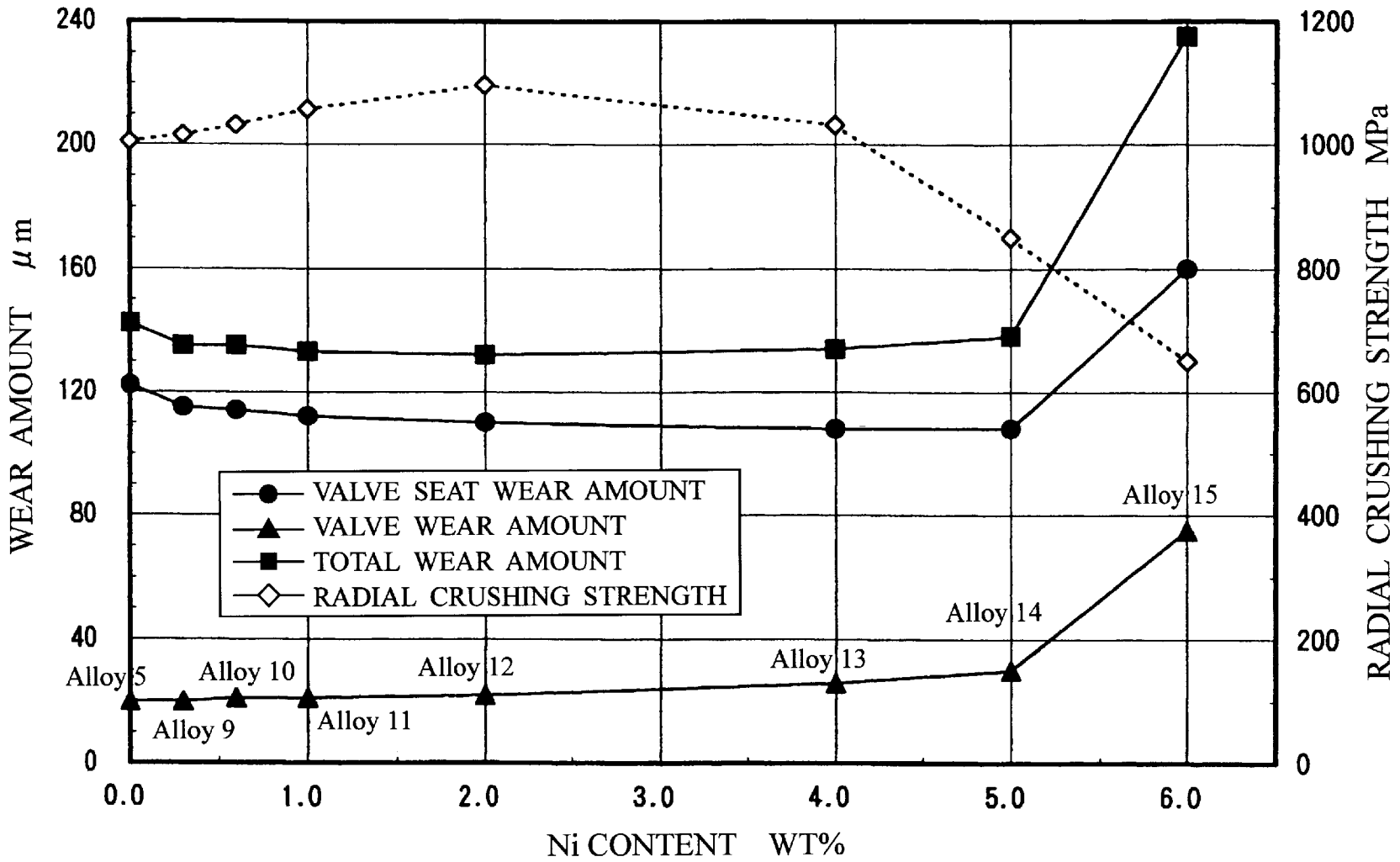
FIG. 5 is a graph showing the effect of Ni content on wear amount and radial crushing strength.

FIG. 4 shows the relationships between the Ni content of each alloy (alloys 5, 9 to 15) of differing the Ni content and matrix hardness or the bainite content, and FIG. 5 shows the relationships between the Ni content of each alloy and the wear amount or the radial crushing strength. As is apparent from FIGS. 4 and 5, when the Ni content is 0.6% or more, the matrix hardness remarkably increases and the radial crushing strength increases. Then, the martensite content and the matrix hardness increase with the increase of the Ni content, and therefore the wear amounts of valve and valve seat are stabilized at low values and the radial crushing strength is also high. However, in alloy 15 in which the Ni content exceeds 5%, since the martensite content is 100%, the hardness of the valve seat exceeds 850 Hv, and therefore the wear amounts of the valve and valve seat remarkably increase and the radial crushing strength is also lowered.

(3) Effect of Ni Content in Fe—Mo Alloy Powder

Figure 6:
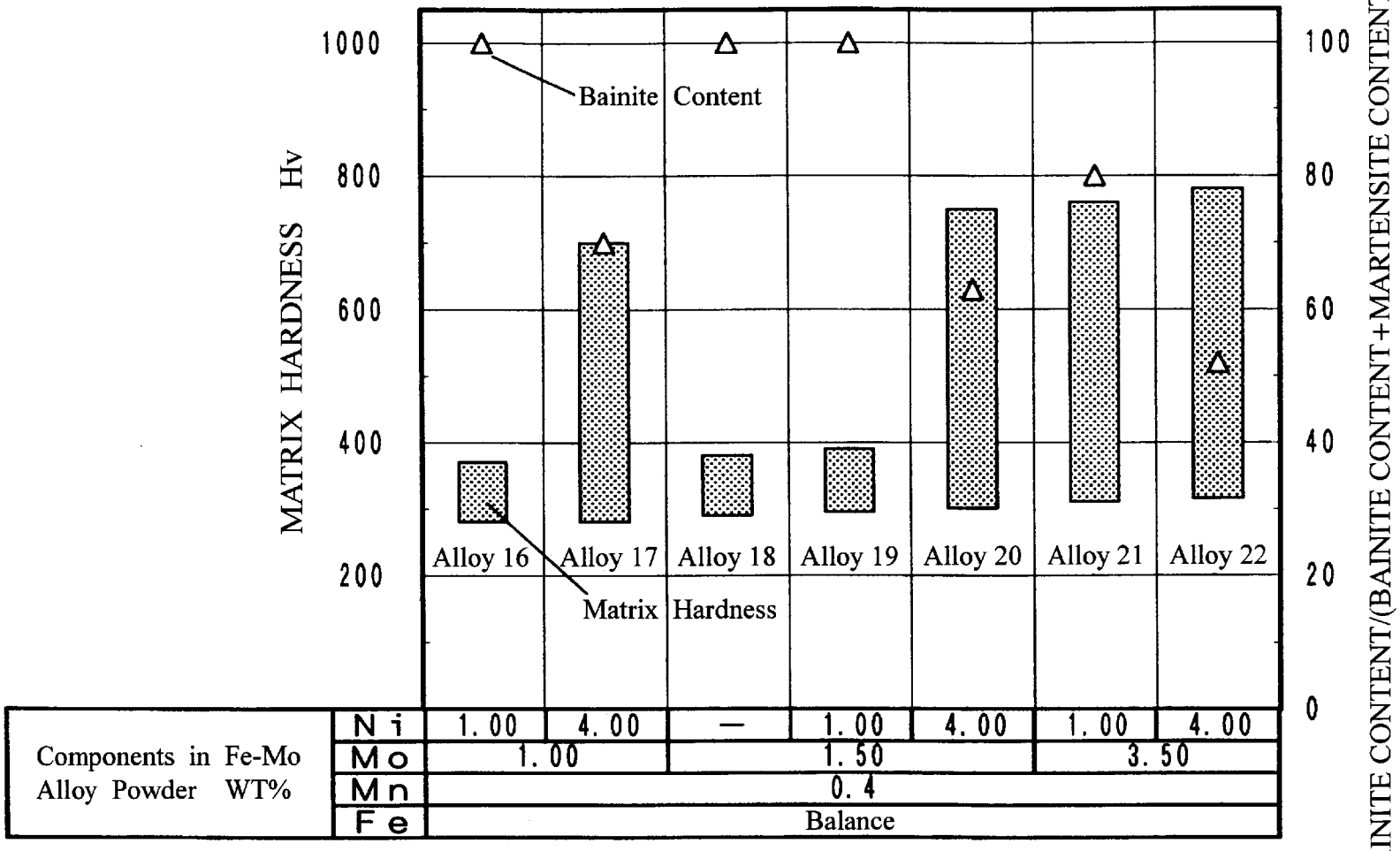
FIG. 6 is a graph showing the effect of Ni content in an alloy powder on matrix hardness and bainite content.
Figure 7:
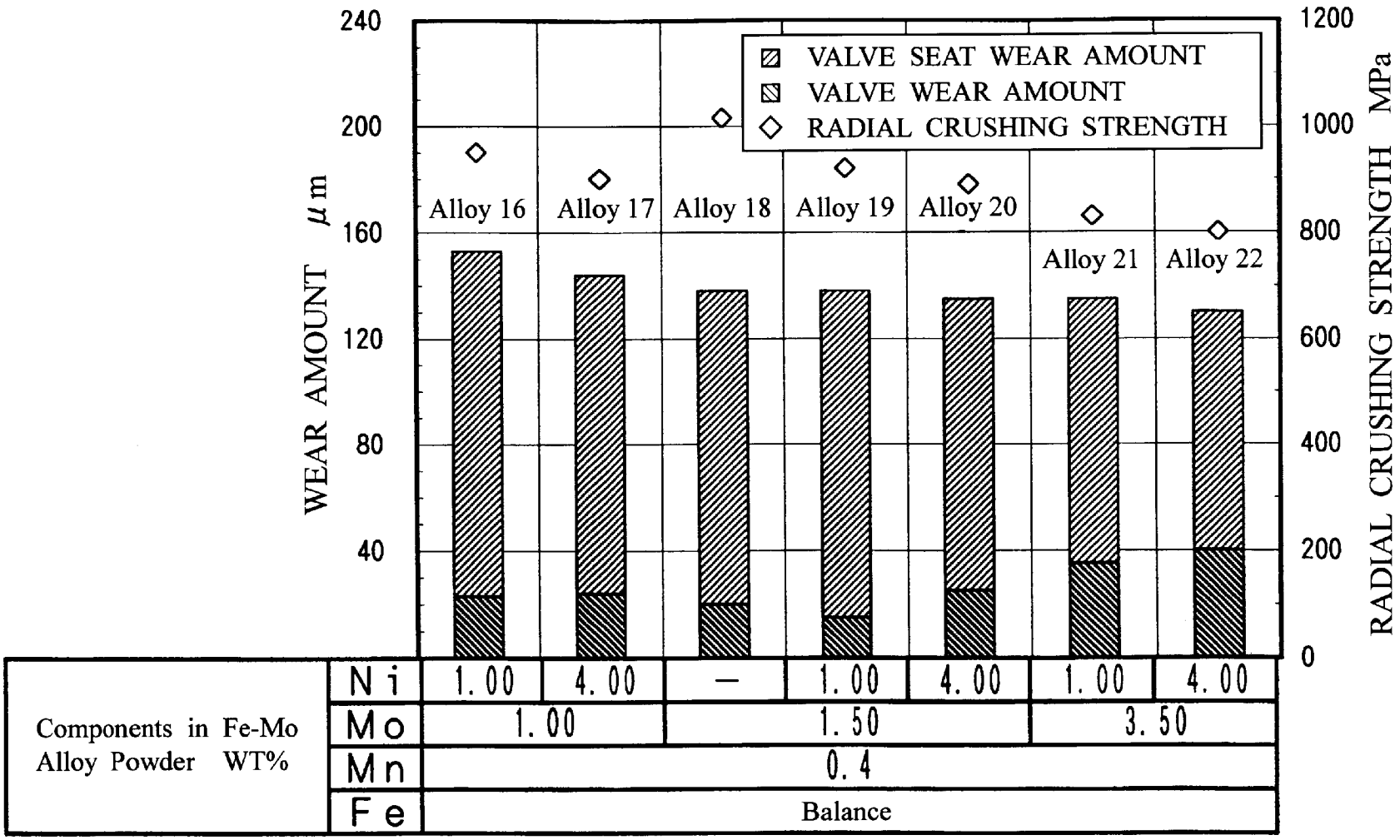
FIG. 7 is a graph showing the effect of Ni content in an alloy powder on wear amount and radial crushing strength.

FIG. 6 shows the relationships between the Ni content of each alloy (alloys 16 to 22) in which the Ni content is variously set in Fe—Mo alloy powder and the matrix hardness or the bainite content, and FIG. 7 shows the relationships between the Ni content of each alloy and the wear amount or the radial crushing strength. As is apparent from FIGS. 6 and 7, in alloys 17 and 20 to 22 in which alloy powder containing Ni of 4% is used, matrixes are harder and the wear amount of the valve seat is also lower than those of an alloy in which powder containing Ni of 1% is used.

(4) Effect of Cr Content

Figure 8:
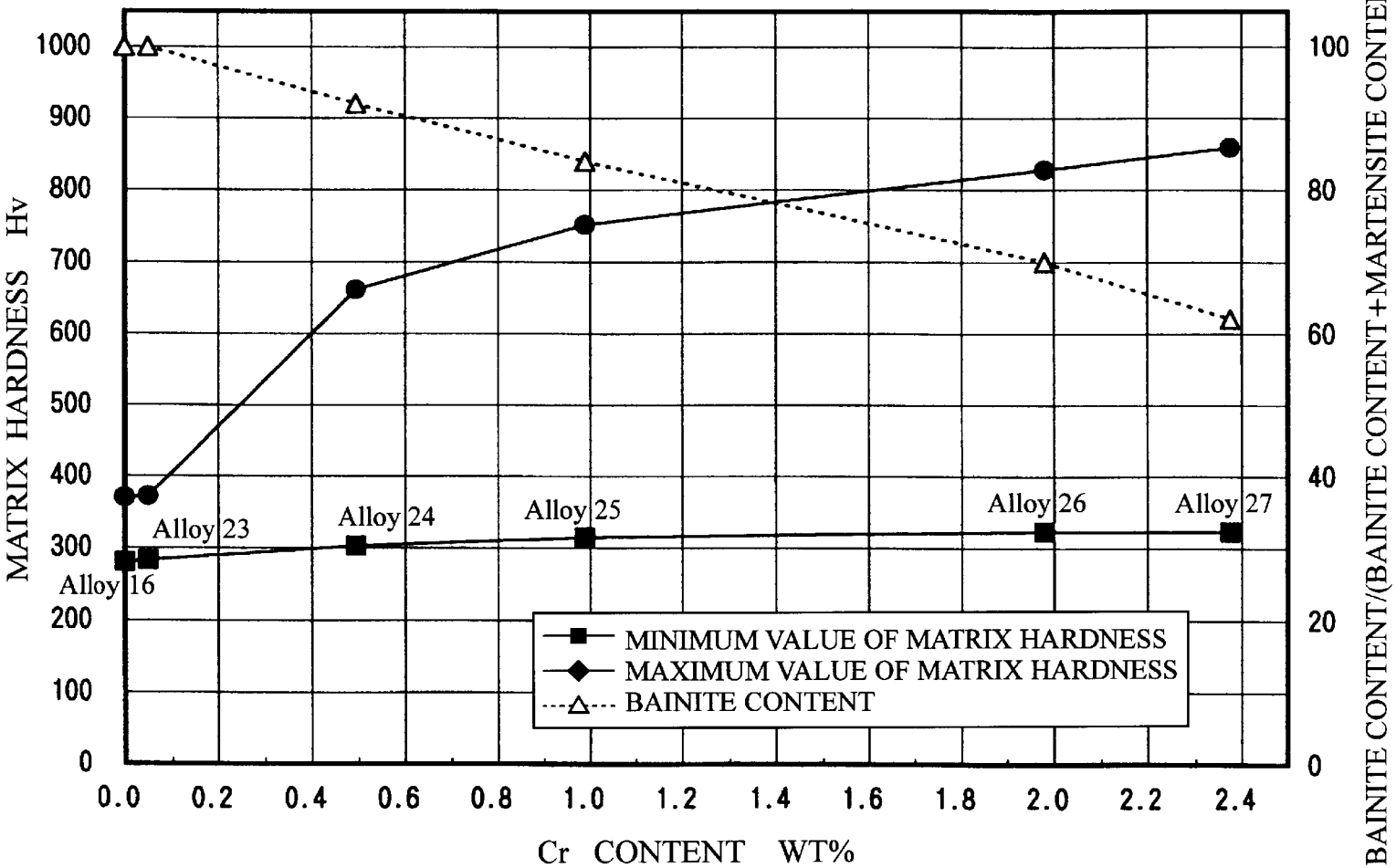
FIG. 8 is a graph showing the effect of Cr content on matrix hardness and bainite content.
Figure 9:
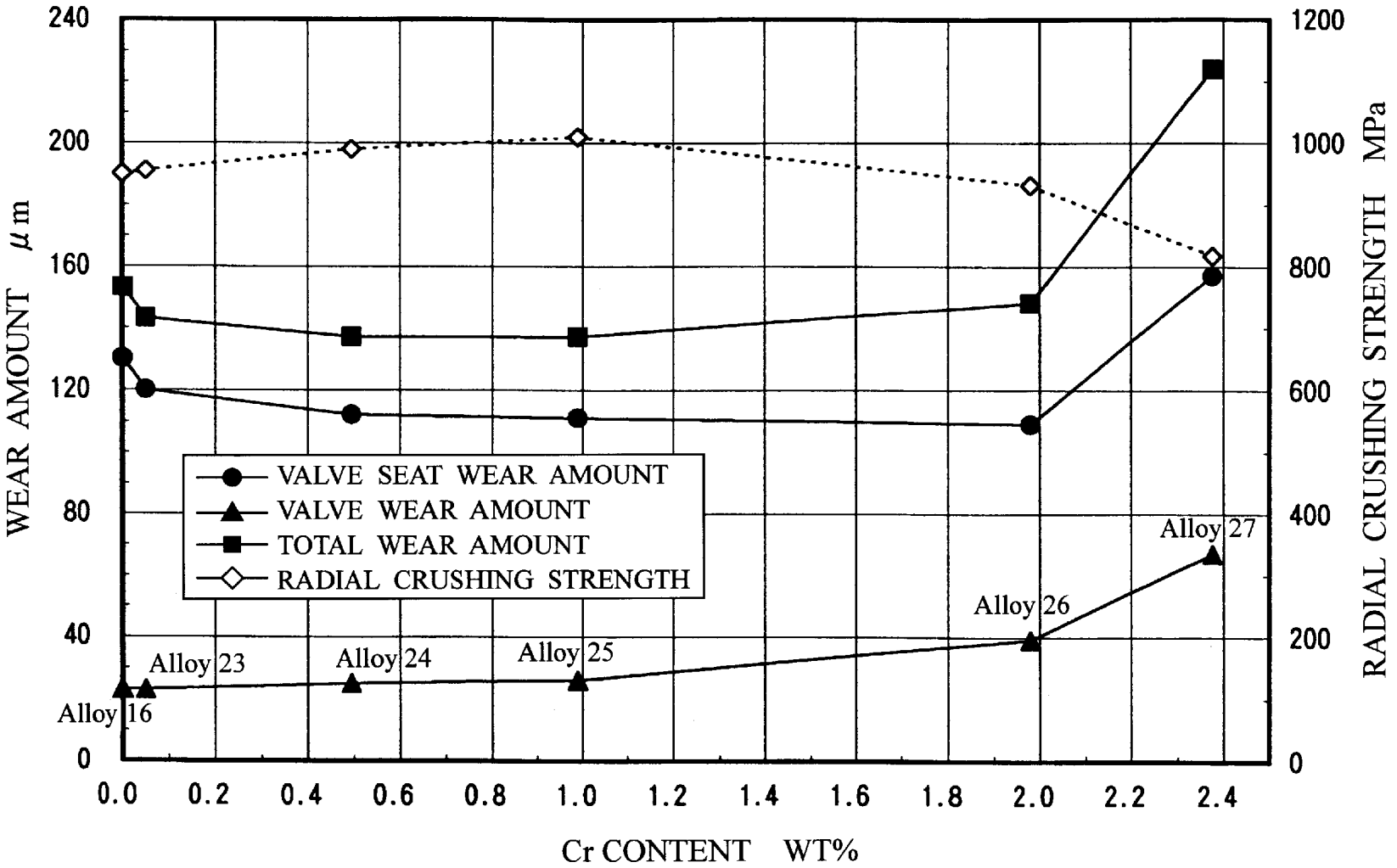
FIG. 9 is a graph showing the effect of Cr content on wear amount and radial crushing strength.

FIG. 8 shows the relationships between the Cr content of each alloy (alloys 16 and 23 to 27) of differing the Cr content and the matrix hardness or the bainite content, and FIG. 9 shows the relationships between the Cr content of each alloy and the wear amount or the radial crushing strength. As is apparent from FIGS. 8 and 9, when the Cr content is 0.05% or more, the matrix hardness increases and the wear amounts of the valve and valve seat decrease. The radial crushing strengths are stabilized at high values. In contrast, in alloy 27 in which the Cr constant exceeds 2%, the wear of the valve is promoted by precipitating Cr carbide, and as the result, the wear of the valve seat also increases.

(5) Effect of Cu Content

Figure 10:
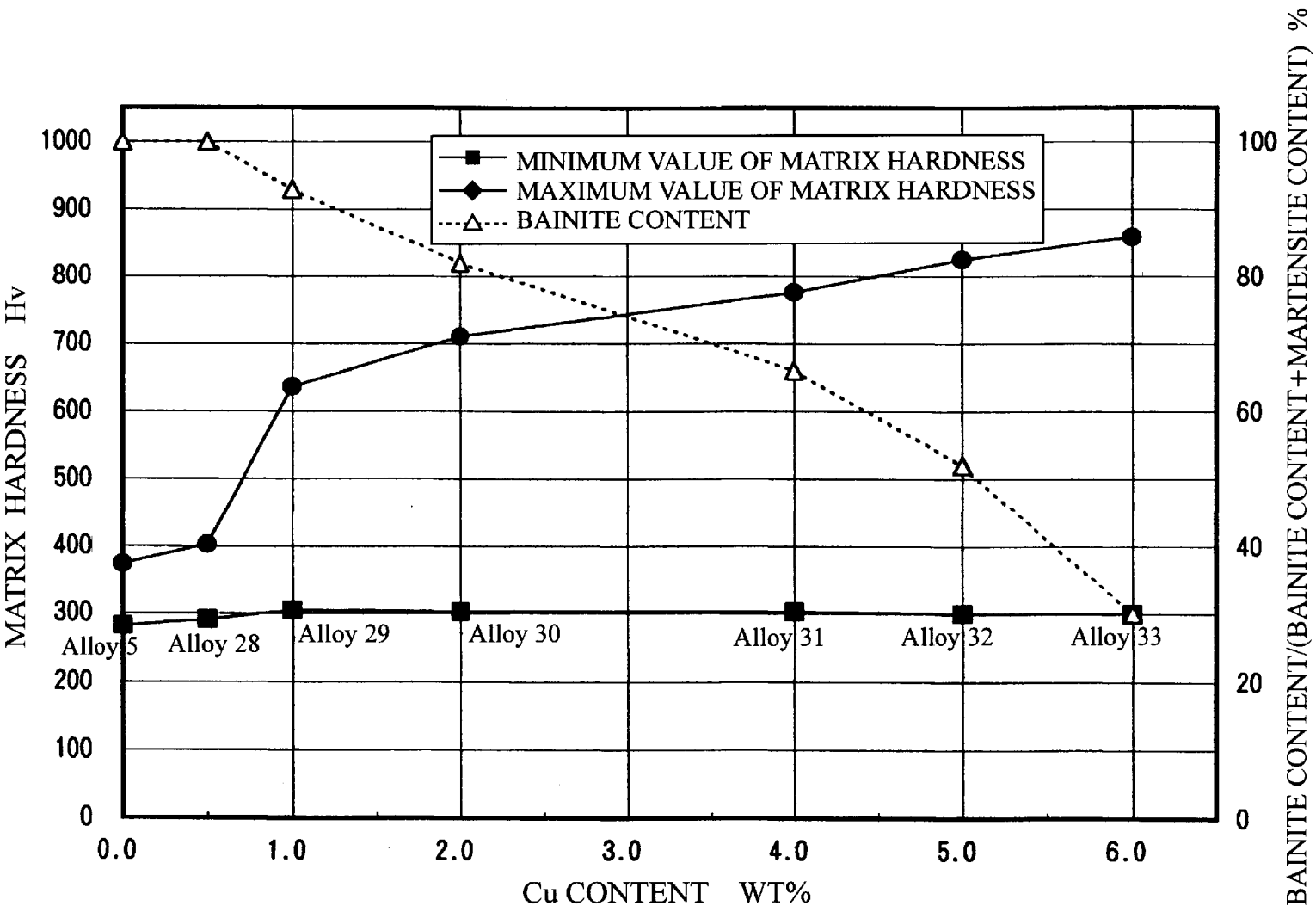
FIG. 10 is a graph showing the effect of Cu content on matrix hardness and bainite content.
Figure 11:
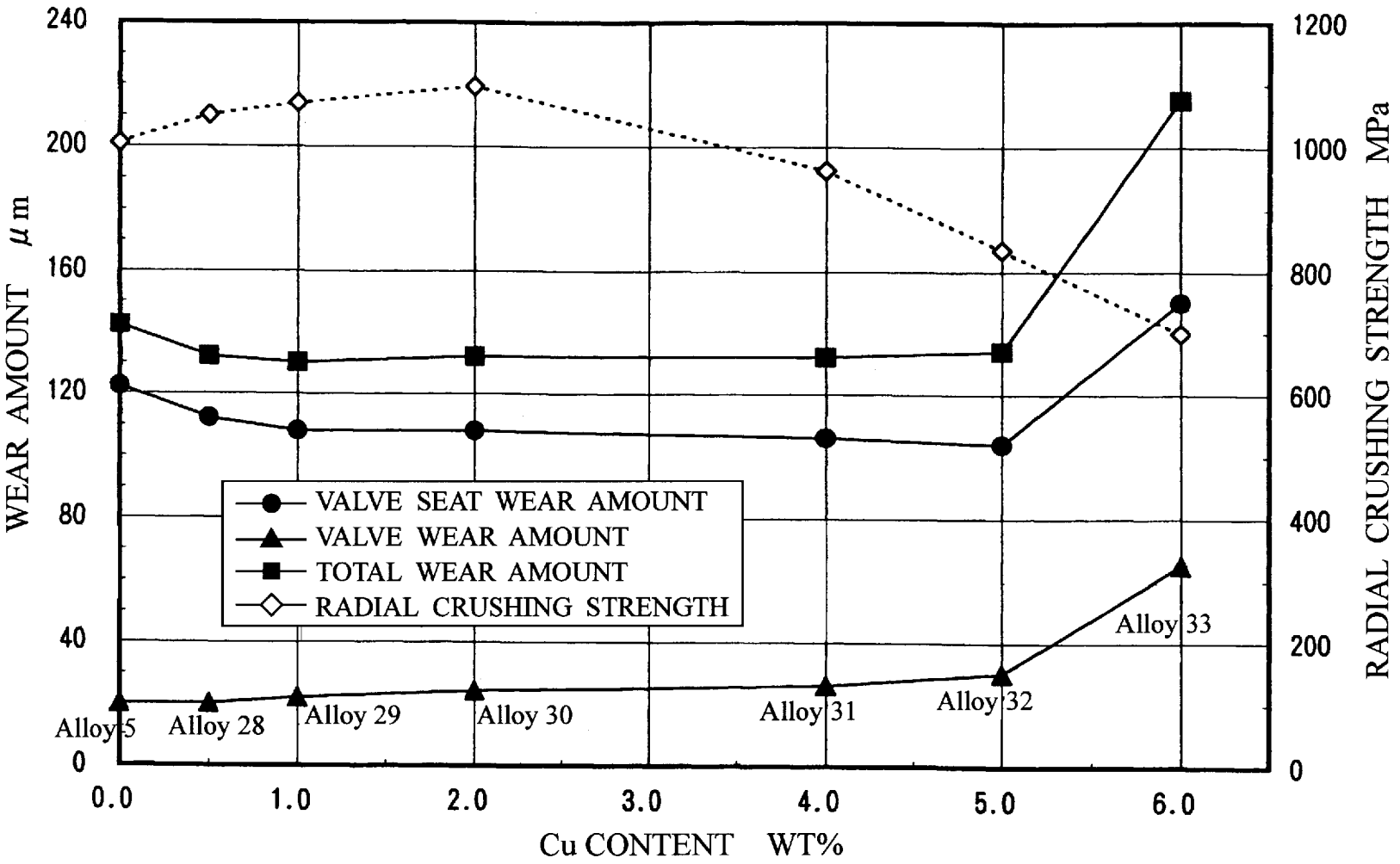
FIG. 11 is a graph showing the effect of Cu content on wear amount and radial crushing strength.

FIG. 10 shows the relationships between the Cu content of each alloy (alloys 5 and 28 to 33) of differing the Cu content and the matrix hardness or the bainite content, and FIG. 11 shows the relationships between the Cu content of each alloy and the wear amount or the radial crushing strength. As is apparent from FIGS. 10 and 11, when the Cu content is 0.5% or more, the matrix hardness increases and the wear amounts of the valve and valve seat decrease. The radial crushing strengths are stabilized at high values. In contrast, in alloy 33 in which the Cu content exceeds 5%, the martensite content exceeds 50% and the wear of valve is promoted, and as a result, the wear of the valve seat also increases.

(6) Effect of C Content

Figure 12:
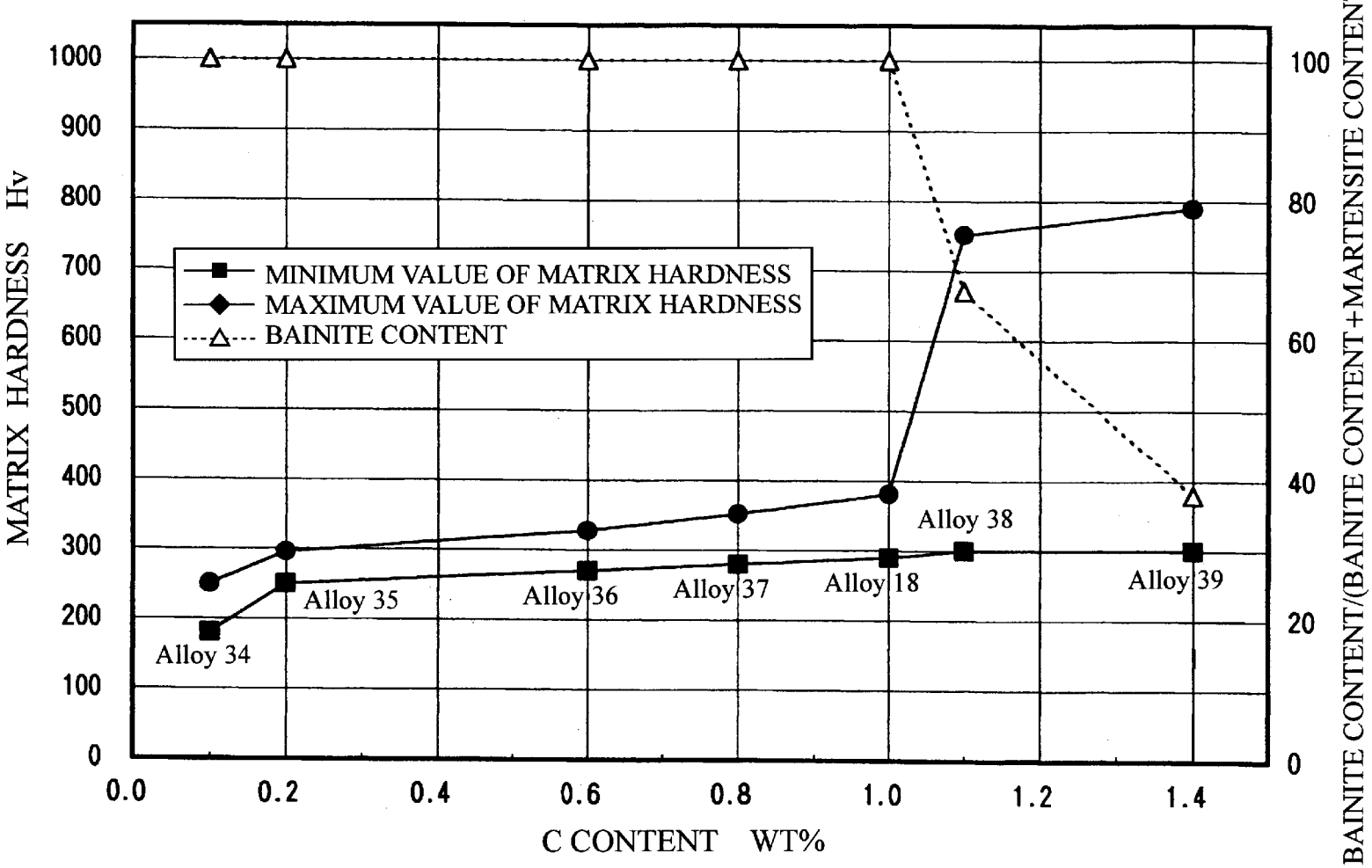
FIG. 12 is a graph showing the effect of C content on matrix hardness and bainite content.
Figure 13:
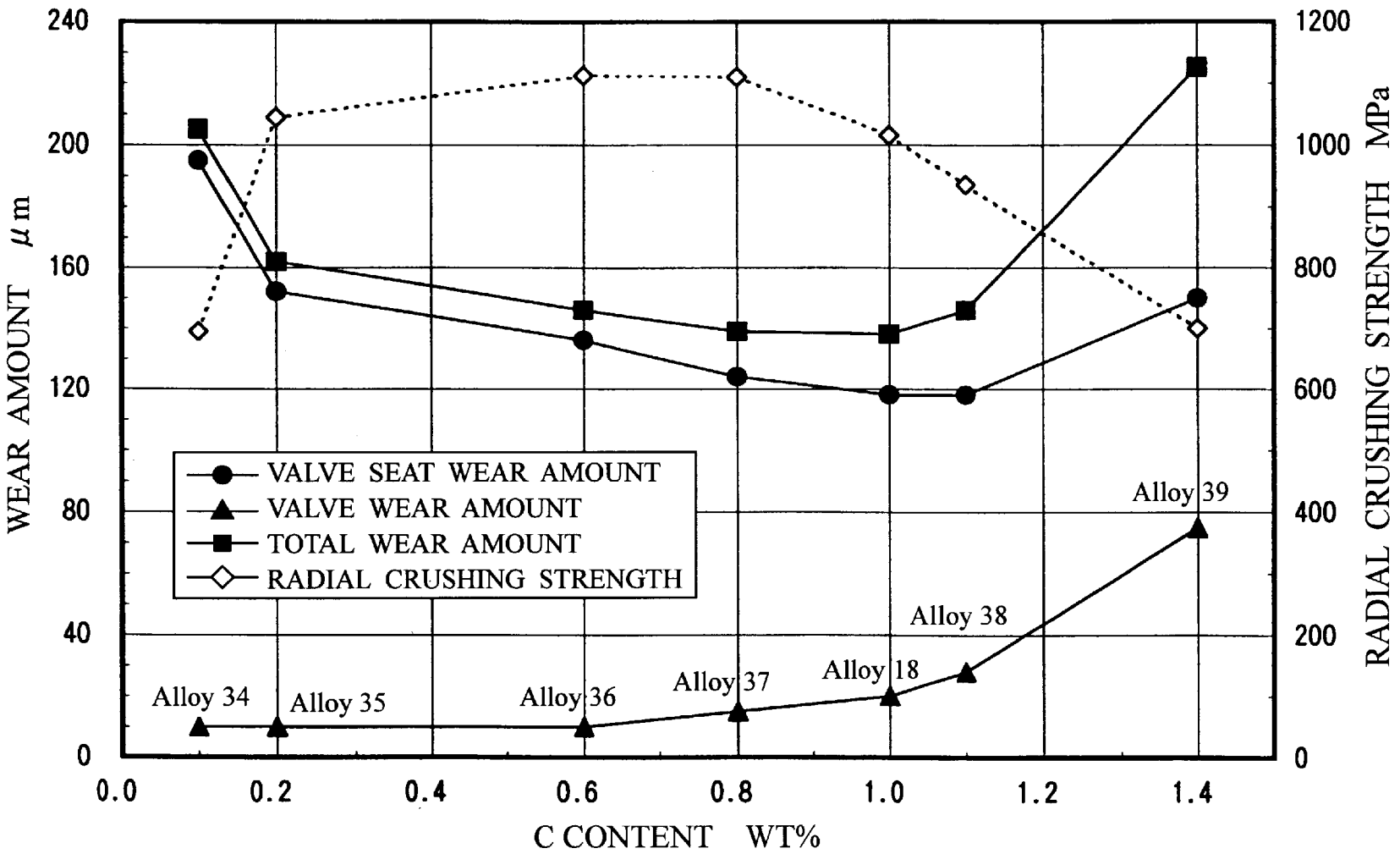
FIG. 13 is a graph showing the effect of C content on wear amount and radial crushing strength.

FIG. 12 shows the relationships between the C content of each alloy (alloys 34 to 39) of differing the C content and the matrix hardness or the bainite content, and FIG. 13 shows the relationships between the C content of each alloy and the wear amount and the radial crushing strength. As is apparent from FIGS. 12 and 13, when the C content is 0.2% or more, the matrix hardness increases, and the wear amounts of the valve and valve seat remarkably decrease and the radial crushing strength remarkably increases. In contrast, in alloy 39 in which the C content exceeds 1.1%, hyper-eutectoid carbide is precipitated, the martensite content exceeds 50%, and the wear of the valve is promoted, and as a result, the wear of the valve seat also increases.

(7) Effect of MnS Content

Figure 14:
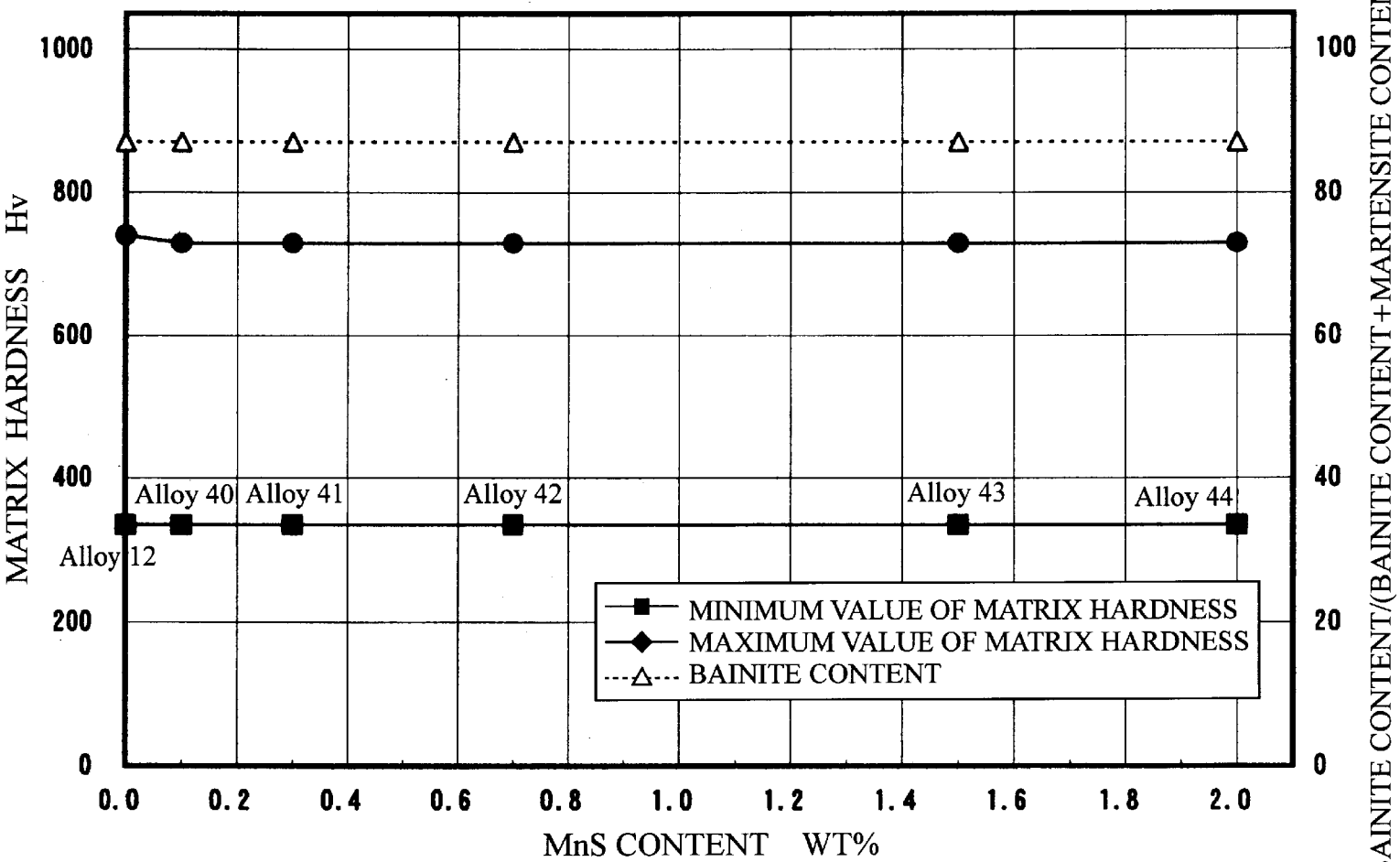
FIG. 14 is a graph showing the effect of MnS content on matrix hardness and bainite content.
Figure 15:
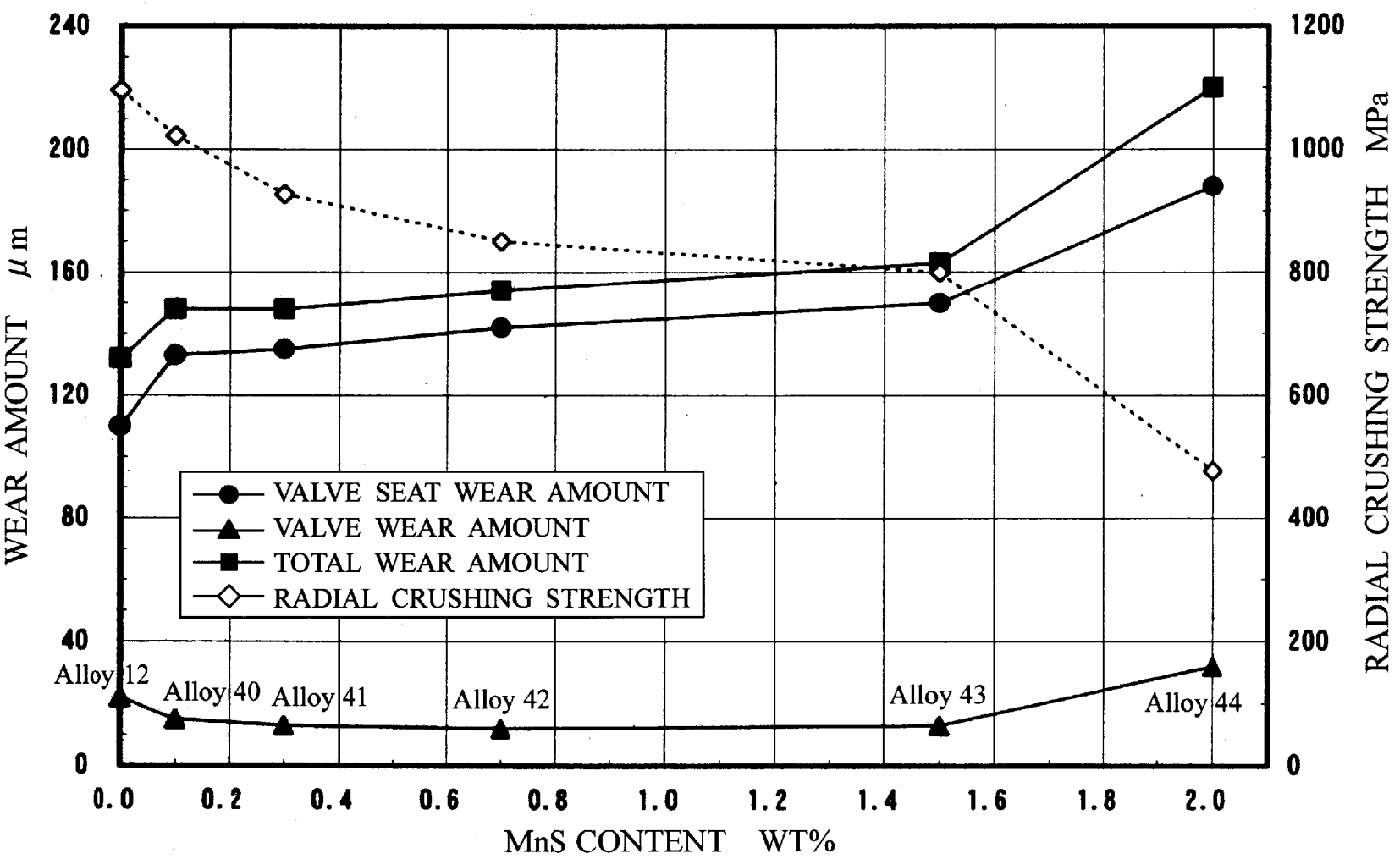
FIG. 15 is a graph showing the effect of MnS content on wear amount and radial crushing strength.

FIG. 14 shows the relationships between the MnS content of each alloy (alloys 12 and 40 to 44) of differing the MnS content and the matrix hardness or the bainite content, and FIG. 15 shows the relationships between the MnS content of each alloy and the wear amount or the radial crushing strength. As is apparent from FIGS. 12 and 13, the matrix hardness is not changed at 250 Hv, even if the MnS content is changed, and the wear amounts of the valve and valve seat are stabilized at low values until the MnS content is about 1%.

(8) Effect of Machinability Improving Component

Figure 16:
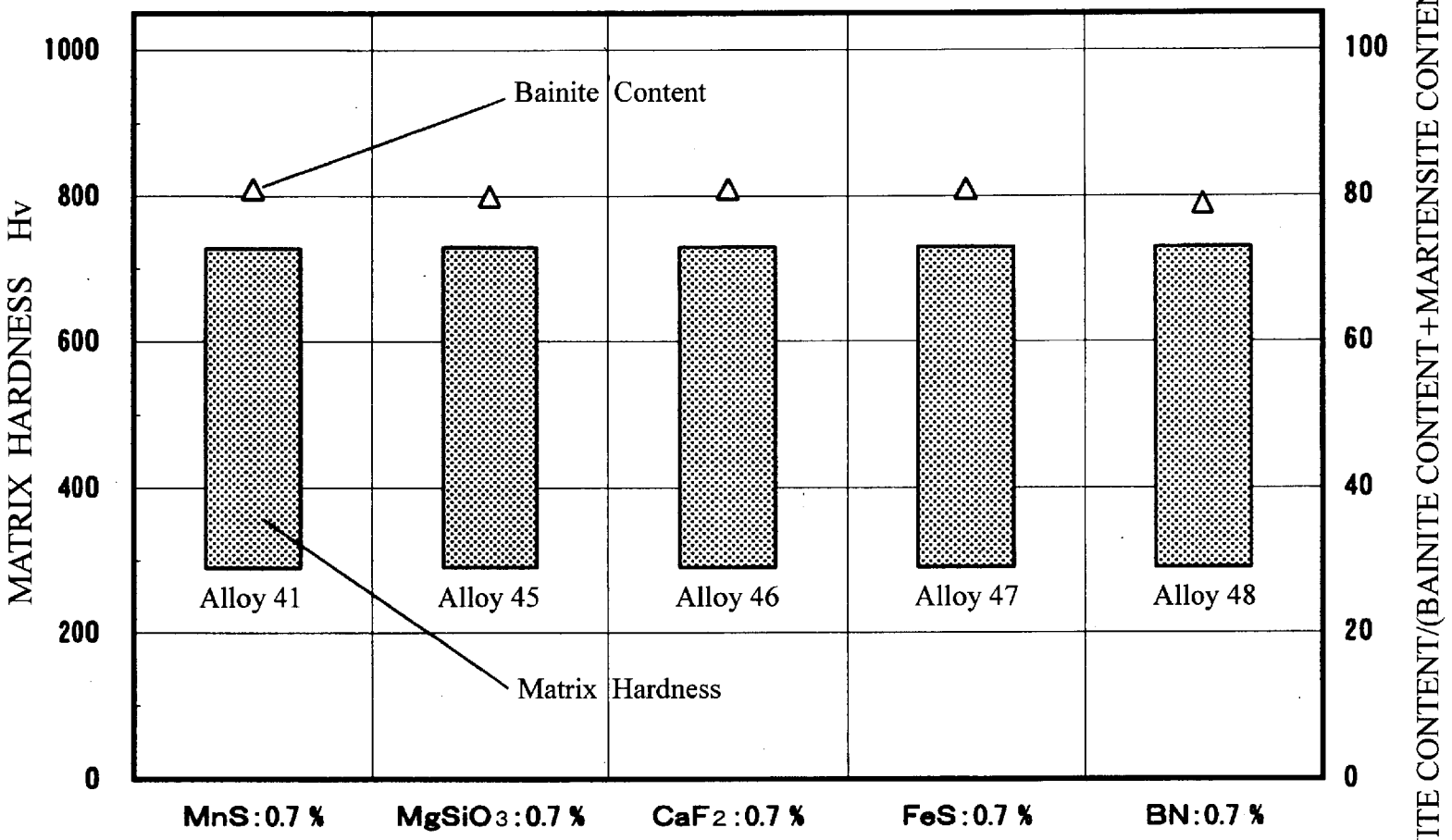
FIG. 16 is a graph showing the effect of machinability improving components on matrix hardness and bainite content.
Figure 17:
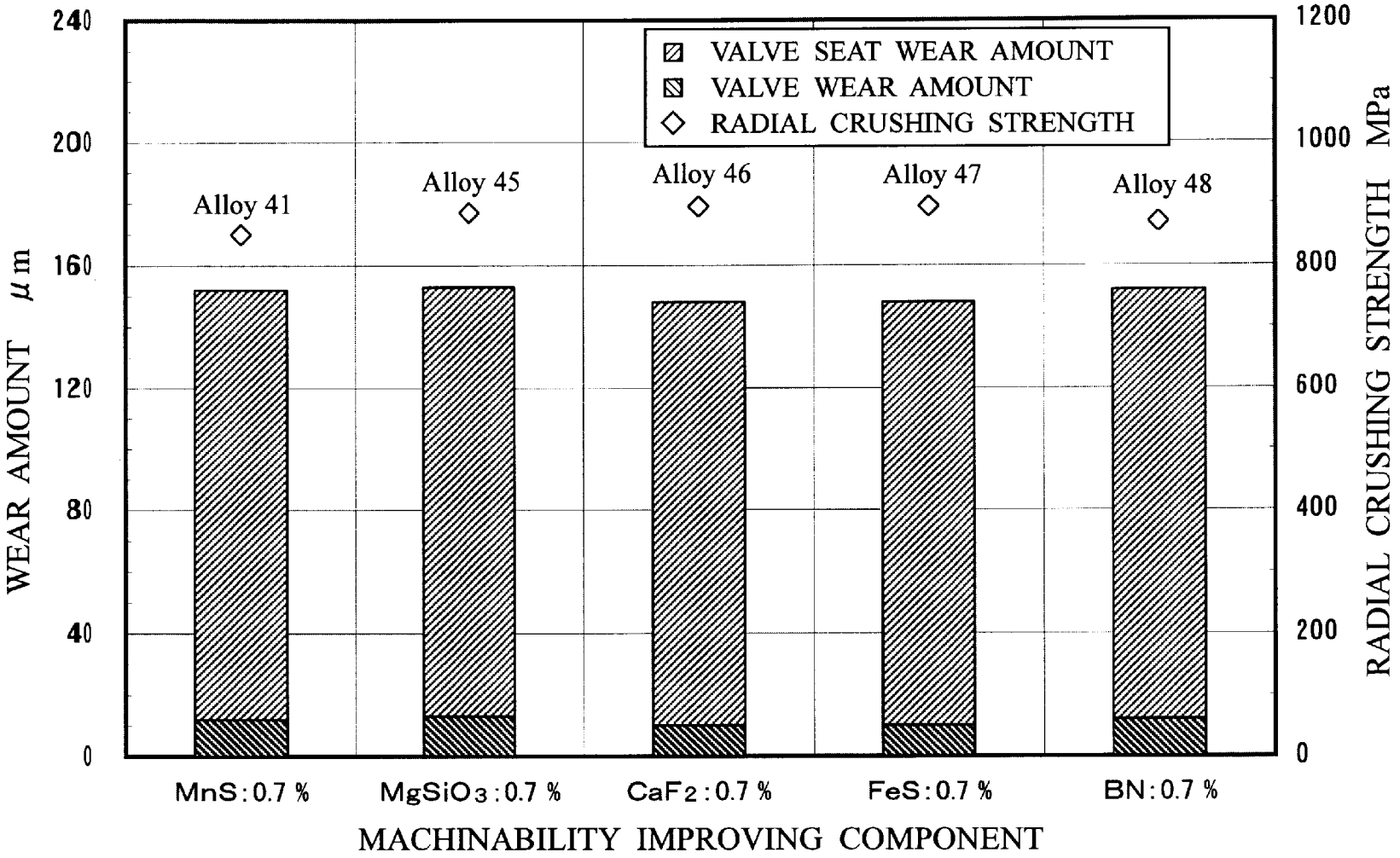
FIG. 17 is a graph showing the effect of machinability improving components on wear amount and radial crushing strength.

FIG. 16 shows the matrix hardness and the bainite content of alloys (alloys 41 and 45 to 48) in which machinability improving components are variously contained, and FIG. 17 shows the wear amount and the radial crushing strength of each alloy. As is apparent from FIGS. 16 and 17, the matrix hardness is 250 Hv or more, even if a machinability improving component is contained and the wear amounts of the valve and valve seat are also stabilized at low values. The radial crushing strengths are also stabilized at 850 MPa or more.

(9) Effect of Infiltration and Impregnation

Figure 18:
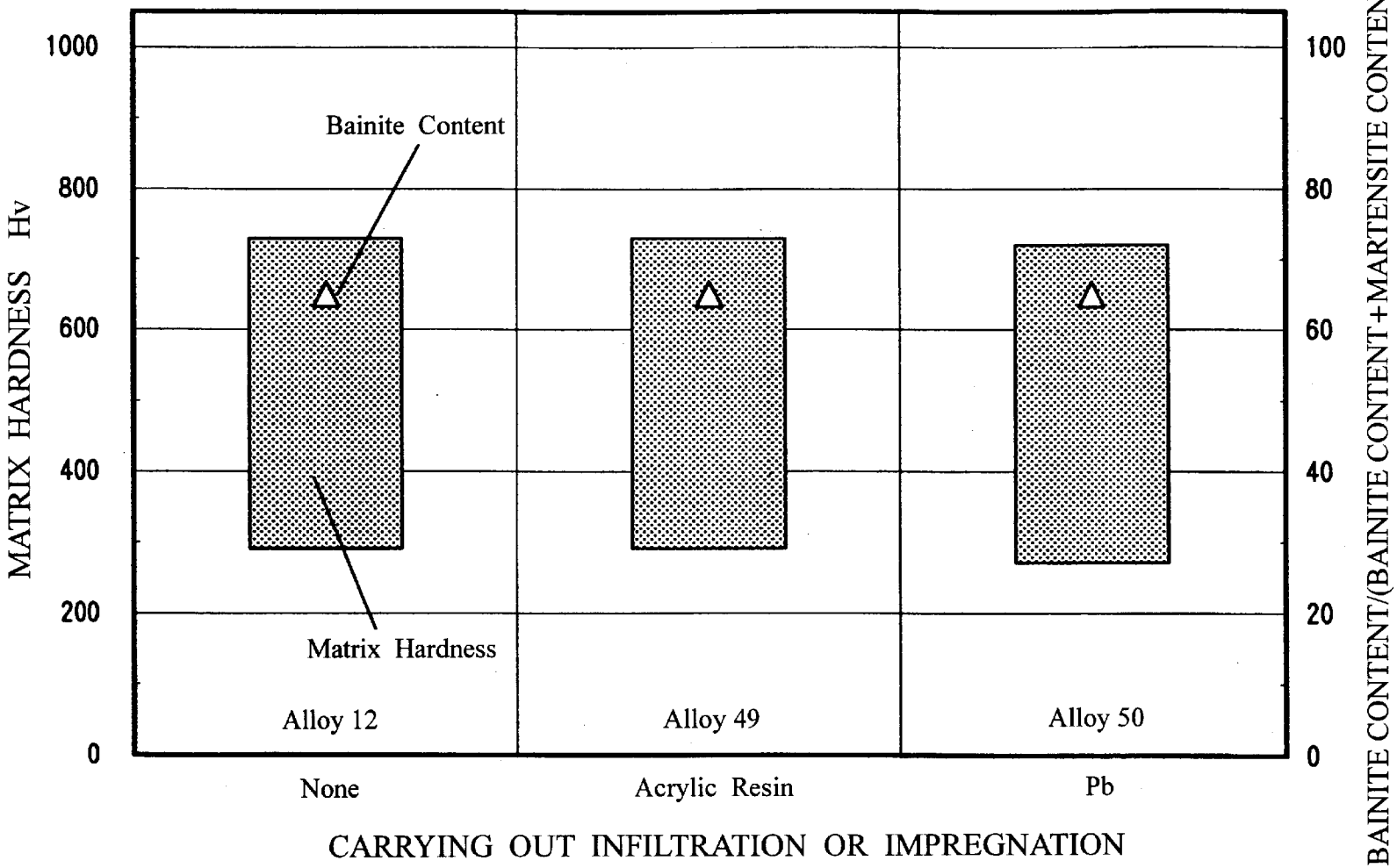
FIG. 18 is a graph showing the effect of infiltration or impregnation of machinability improving components on matrix hardness and bainite content.
Figure 19:
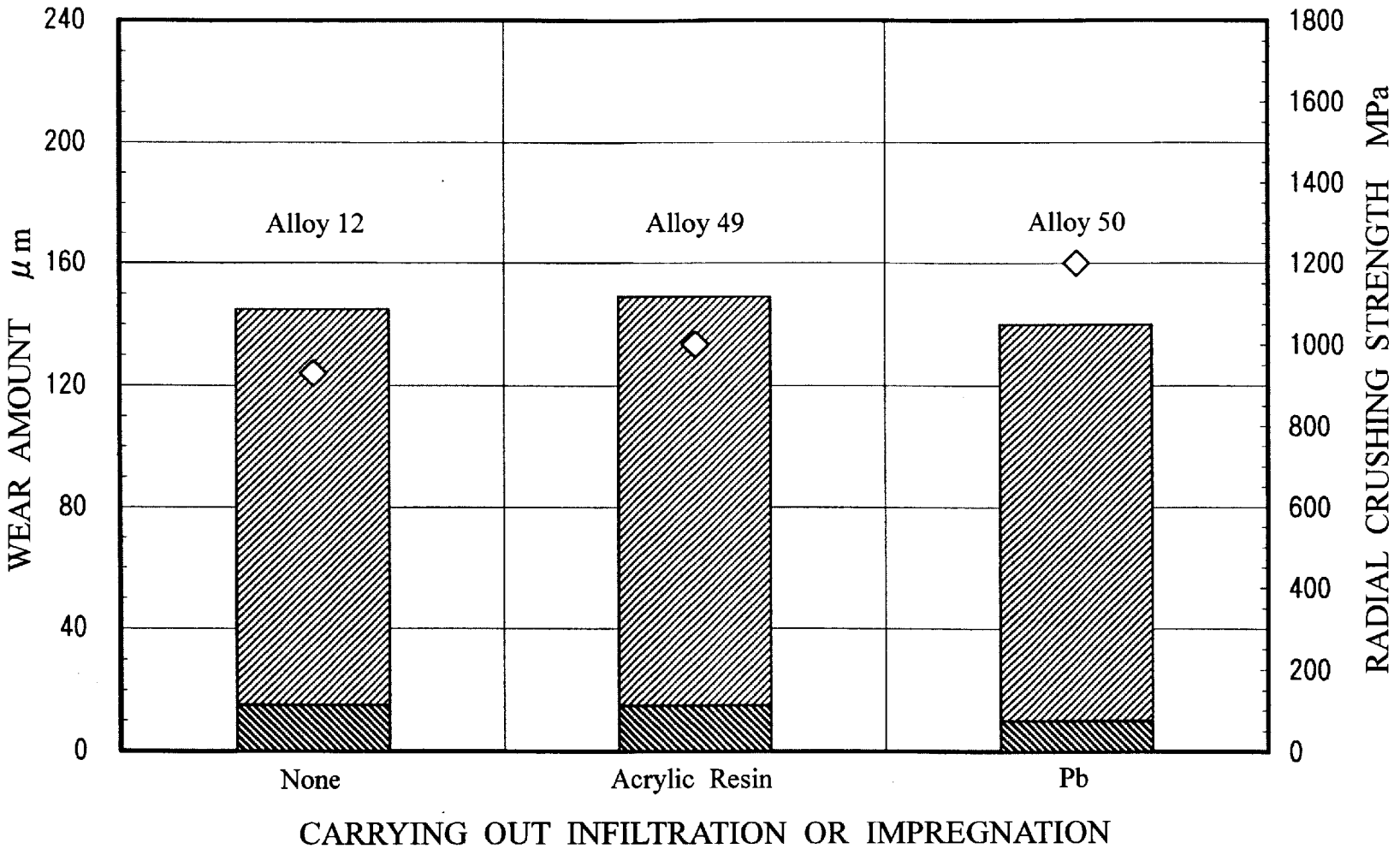
FIG. 19 is a graph showing the effect of infiltration or impregnation of machinability improving components on wear amount and radial crushing strength.

FIG. 18 shows the matrix hardness and the bainite content of alloys (alloys 12 and 49, and 50) in which a machinability improving component is infiltrated or impregnated in pores, and FIG. 19 shows the wear amount and the radial crushing strength of each alloy. As is apparent from FIGS. 18 and 19, the matrix hardness is 250 Hv or more, even if a machinability improving component is contained and the wear amounts of the valve and valve seat are also stabilized at low values. The radial crushing strengths are also stabilized at 900 MPa or more.

As explained above, according to the present invention, improvement of machinability and the holding down of cost can be achieved by optimizing the matrix structure and ensuring the wear resistance without expensive hard particles. Therefore, the present invention can provide a valve seat which is inexpensive and is of high quality.

What is claimed is:

1. A valve seat for internal combustion engines comprising:

0.4 to 4% by weight of molybdenum:

0.2 to 1.1% by weight of carbon;

at least one of 0.6 to 5% by weight of nickel, 0.5 to 5% by weight of copper, 0.05% to 2% by weight of chromium, 0.09 to 1% by weight of manganese and 0.05% to 0.6% by weight of vanadium; and the balance iron and inevitable impurities, wherein said valve seat exhibits a metallographic structure consisting of an iron-based matrix, said iron-based matrix is selected from the group consisting of a bainite single phase and a mixed phase of bainite and martensite, said banite and martensite are present in cross-section in a ratio of 100:0 to 50:50, and said iron-based matrix having a hardness of 250 to 850 Hv.

2. A valve seat for internal combustion engines in accordance with claim 1, wherein said carbon is contained in eutectoid or hypo-eutectoid composition amount.

3. A valve seat for internal combustion engines in accordance with claim 1, wherein a material selected from the group consisting of an acrylic resin, lead, and lead alloy is dispersed by filling in pores.

4. A valve seat for internal combustion engines in accordance with claim 2, wherein a material is selected from the group consisting of an acrylic resin, lead, and lead alloy is dispersed by filling in pores.-

5. A valve seat for internal combustion engines in accordance with claim 1 further comprising:

at least one of manganese sulfide particle;

magnesium metasilicate mineral particle;

calcium fluoride particle;

boron nitride particle;

molybdenum disulfide particle; and iron sulfide particle;

wherein said particle is dispersed in said metallographic structure in concentration in the range from 0.1% to 1.5% by weight.

6. A valve seat for internal combustion engines in accordance with claim 5, wherein said carbon is contained in eutectoid or hypo-eutectoid composition amount.

7. A valve seat for internal combustion engines consisting of:

0.4 to 4% by weight of molybdenum;

0.2 to 1.1% by weight of carbon; and the balance iron and inevitable impurities, wherein said valve seat exhibits a metallographic structure consisting of an iron-based matrix, said iron-based matrix is selected from the group consisting of a bainite single phase and a mixed phase of bainite and martensite, said banite and martensite are present in cross-section in a ratio of 100:0 to 50:50, and said iron-based matrix having a hardness of 250 to 850 Hv.

8. A valve seat for internal combustion engines in accordance with claim 7, wherein said carbon is contained in eutectoid or hypo-eutectoid composition amount.

9. A valve seat for internal combustion engines in accordance with claim 7, wherein a material selected from the group consisting of an acrylic resin, lead, and lead alloy is dispersed by filling in pores.

10. A valve seat for combustion engines in accordance with claim 8, wherein a material selected from the group consisting of an acrylic resin, lead, and lead alloy is dispersed by filling in pores.

11. A valve seat for internal combustion engines consisting of:

0.4 to 4% by weight of molybdenum;

0.2 to 1.1% by weight of carbon;

0.1 to 1.5% by weigh of at least one of manganese sulfide, magnesium metasilicate mineral, calcium fluoride, boron nitride, molybdenum disulfide, and iron sulfide; and the balance iron and inevitable impurities, wherein said value seat exhibits a metallographic structure consisting of an iron-based matrix, said iron-based matrix is selected from the group consisting of a bainiate single phase and a mixed phase of bainite and martensite, said bainite and martensite are present in cross-section in a ratio of 100:0 to 50:50, said iron-based matrix having a hardness of 250 to 850 Hv, and said at least one of manganese sulfide, magnesium metasilicate mineral, calcium disulfide, boron nitride, molybdenum disulfide, and iron sulfide is dispersed in said metallographic structure as a particle.

12. A valve seat for internal combustion engines in accordance with claim 11, wherein said carbon is contained in eutectoid or hypo-eutectoid composition amount.

13. A valve seat for internal combustion engines in accordance with claim 11, wherein a material selected from the group consisting of an acrylic resin, lead, and lead alloy is dispersed by filling in pores.

14. A valve seat for internal combustion engines in accordance with claim 12, wherein a material selected from the group consisting of an acrylic resin, lead, and lead alloy is dispersed by filling in pores.

* * * * *